US012662765B2

(12) United States Patent
Kim et al.

(10) Patent No.: US 12,662,765 B2
(45) Date of Patent: Jun. 23, 2026

(54) LAUNDRY TREATING APPARATUS

(71) Applicant: LG ELECTRONICS INC., Seoul (KR)

(72) Inventors: Younghun Kim, Seoul (KR); Sungwoon Jung, Seoul (KR); Kunwoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 87 days.

(21) Appl. No.: 18/701,528

(22) PCT Filed: Dec. 12, 2022

(86) PCT No.: PCT/KR2022/020095
§ 371 (c)(1),
(2) Date: Apr. 15, 2024

(87) PCT Pub. No.: WO2024/101520
PCT Pub. Date: May 16, 2024

(65) Prior Publication Data

US 2025/0230600 A1 Jul. 17, 2025

(30) Foreign Application Priority Data

Nov. 11, 2022 (KR) ..... 10-2022-0150747

(51) Int. Cl.
*D06F 23/04* (2006.01)
*D06F 34/14* (2020.01)
(Continued)

(52) U.S. Cl.
CPC ..... *D06F 39/028* (2013.01); *D06F 23/04* (2013.01); *D06F 34/14* (2020.02); *D06F 37/12* (2013.01);
(Continued)

(58) Field of Classification Search
None
See application file for complete search history.

(56) References Cited

U.S. PATENT DOCUMENTS

2022/0010474 A1* 1/2022 Kim ..... D06F 23/025

FOREIGN PATENT DOCUMENTS

CN 215714061 U 2/2022
EP 2 604 743 A2 6/2013
(Continued)

*Primary Examiner* — Levon J Shahinian
(74) *Attorney, Agent, or Firm* — Birch, Stewart, Kolasch & Birch, LLP

(57) ABSTRACT

A laundry treating apparatus includes a cabinet, a tub disposed inside the cabinet and containing water therein, a first storage at least partially exposed to the outside of the cabinet and containing first detergent therein, and a second storage disposed inside the cabinet and containing second detergent therein. The second storage is in communication with the tub. The second storage includes a first chamber receiving water, containing the second detergent therein, and in communication with the tub, a second chamber connected to the first chamber, the first detergent being introduced into the second chamber, and a water diffuser disposed in the first chamber and extending to the second chamber to deliver water supplied to the first chamber to the second chamber.

20 Claims, 30 Drawing Sheets

(51) Int. Cl.

| | |
|---|---|
| ***D06F 37/12*** | (2006.01) |
| ***D06F 39/02*** | (2006.01) |
| ***D06F 39/08*** | (2006.01) |
| *D06F 103/00* | (2020.01) |

(52) U.S. Cl.
CPC ..... *D06F 39/02* (2013.01); *D06F 39/022* (2013.01); *D06F 39/088* (2013.01); *D06F 2103/00* (2020.02)

(56) References Cited

FOREIGN PATENT DOCUMENTS

| | | | |
|---|---|---|---|
| KR | 10-2008-0104642 | A | 12/2008 |
| KR | 10-2009-0122005 | A | 11/2009 |
| KR | 10-2018-0080013 | A | 7/2018 |
| KR | 10-2020-007549 | A | 1/2020 |
| KR | 10-2020-0056681 | A | 5/2020 |
| KR | 10-2020-0120202 | A | 10/2020 |

* cited by examiner

【Figure 1】
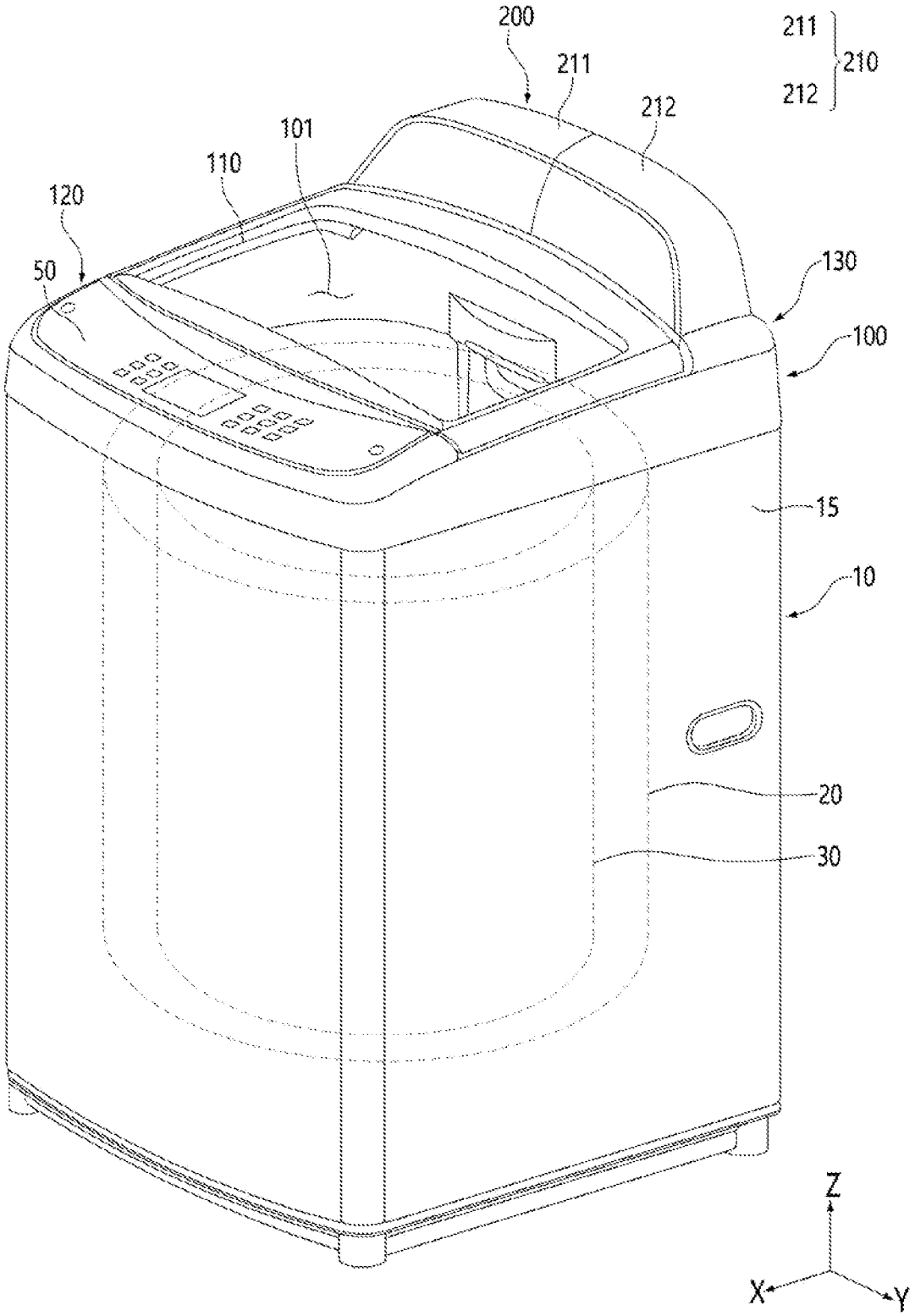

【Figure 2】
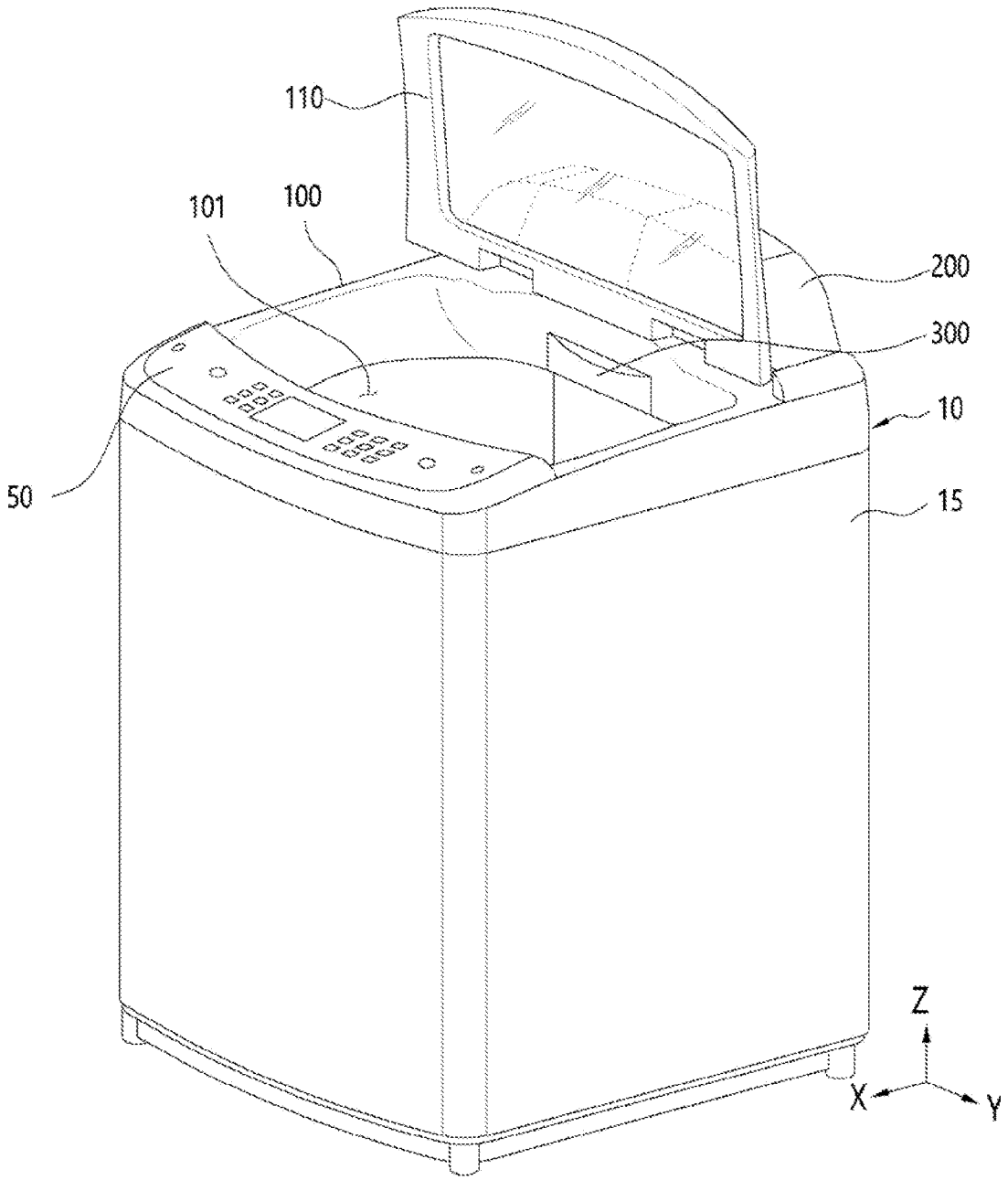

【Figure 3】
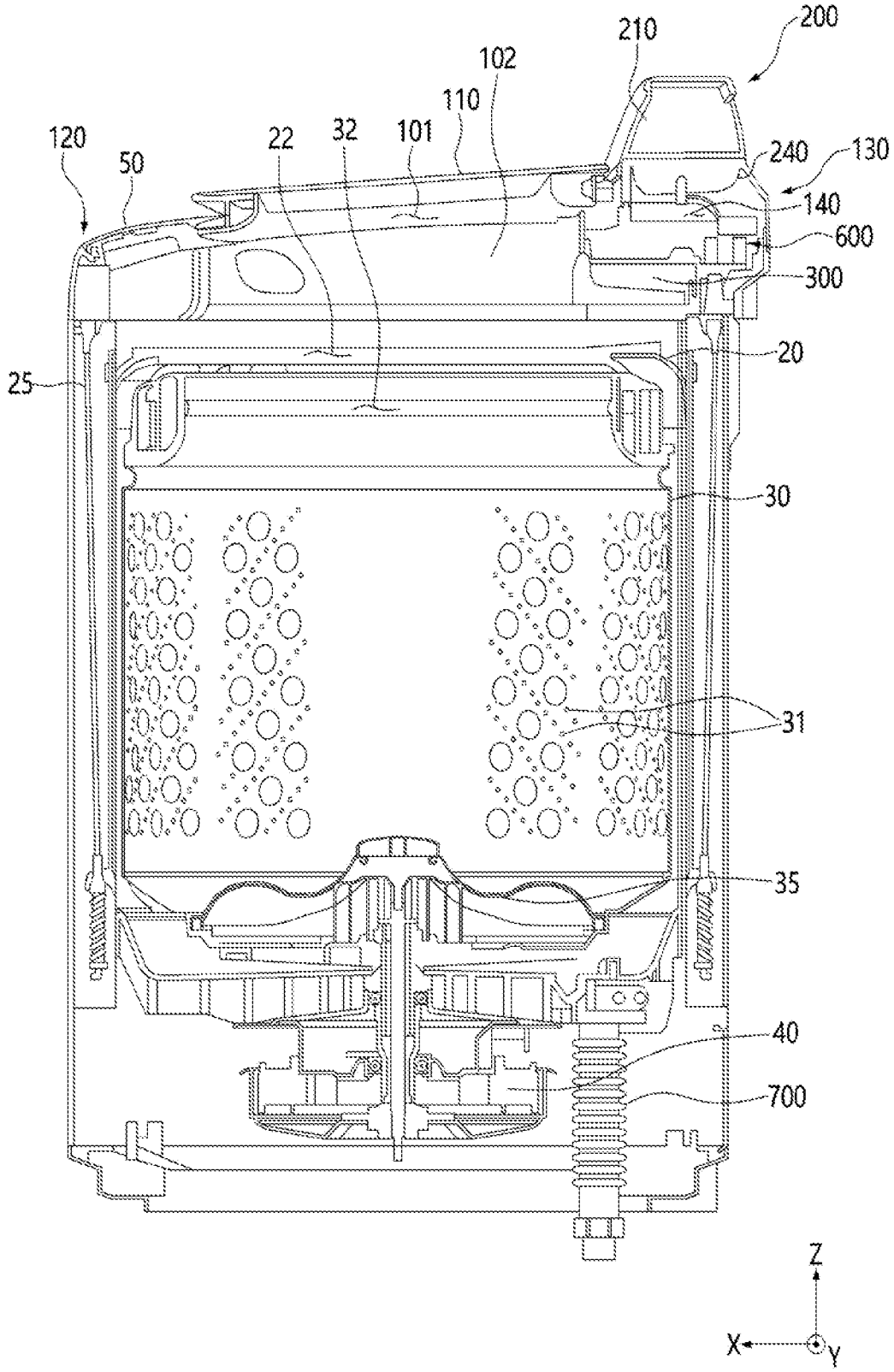

【Figure 4】
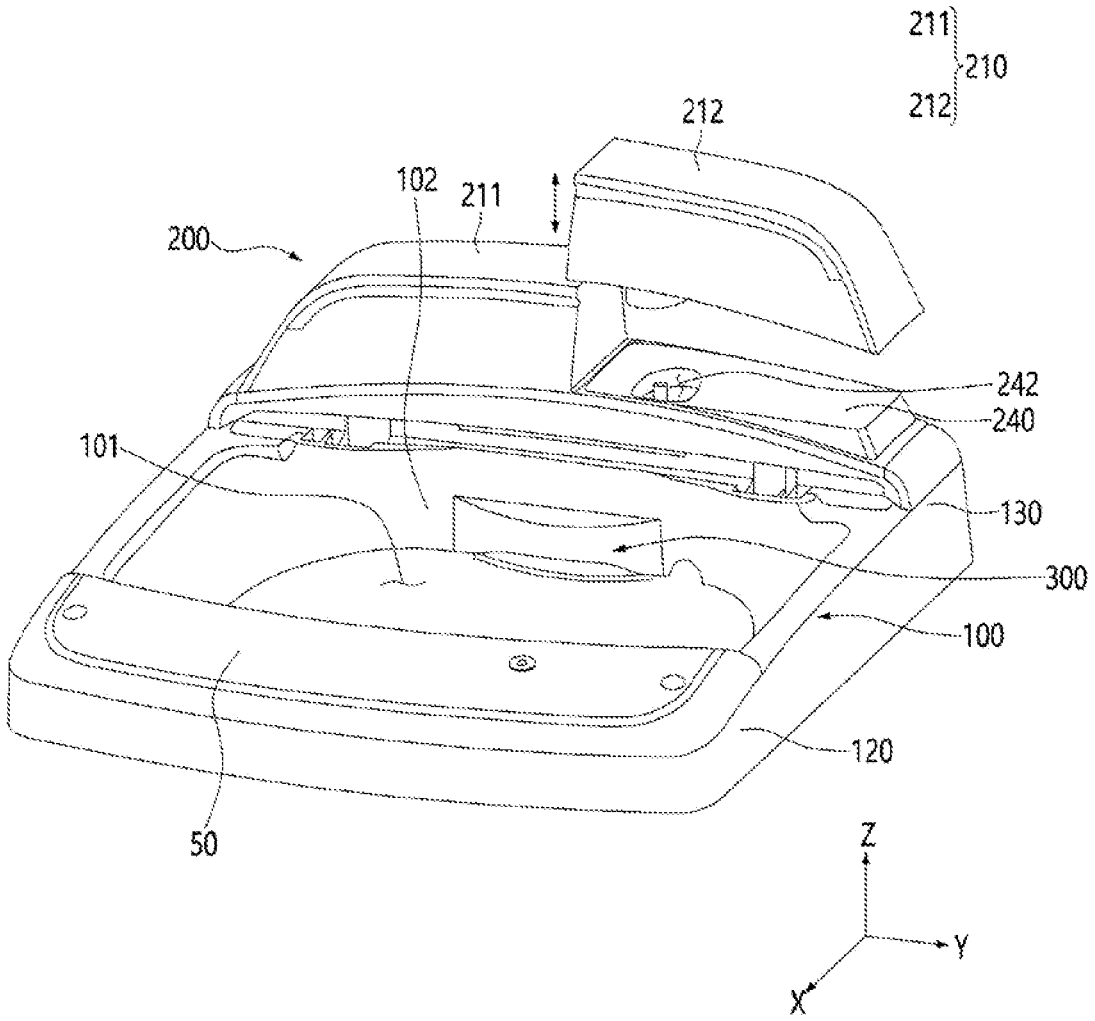

【Figure 5】
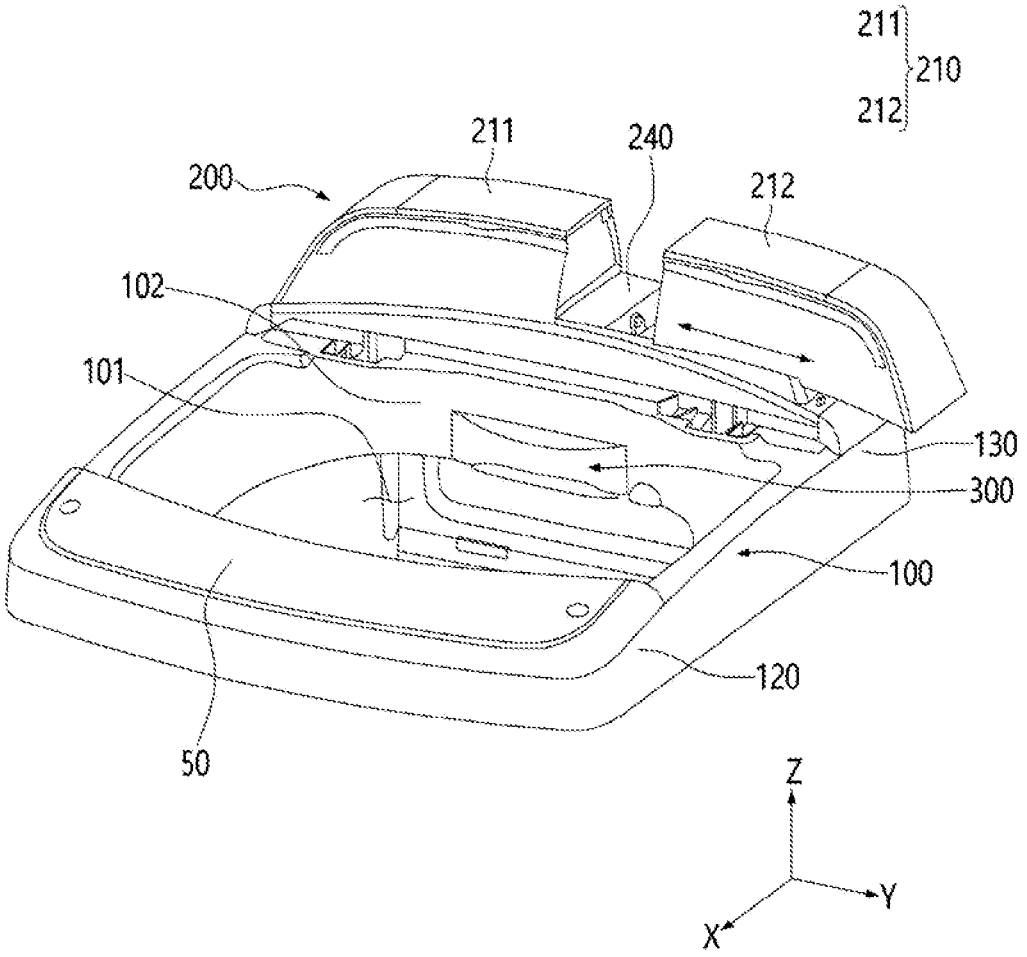

【Figure 6】
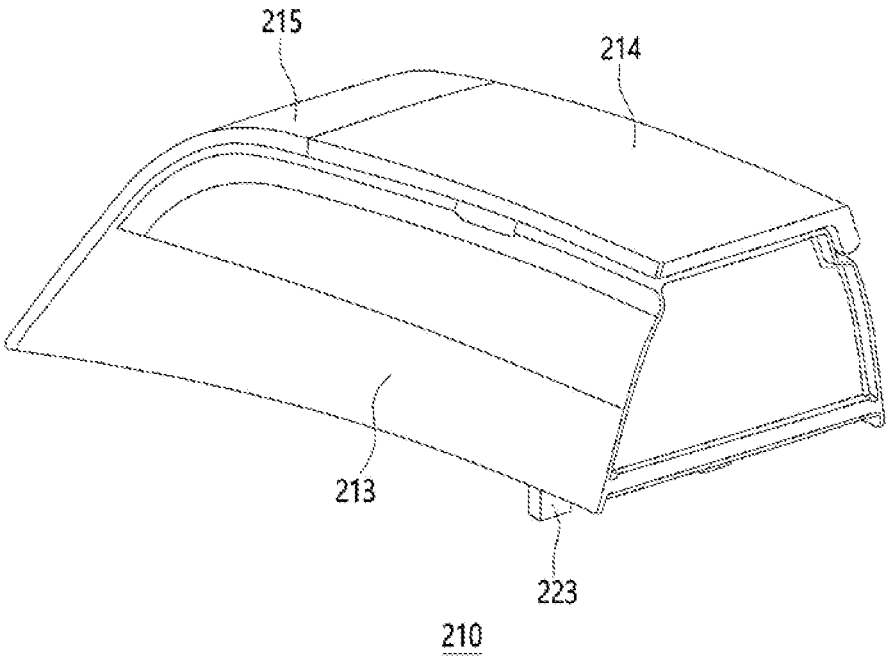
【Figure 7】
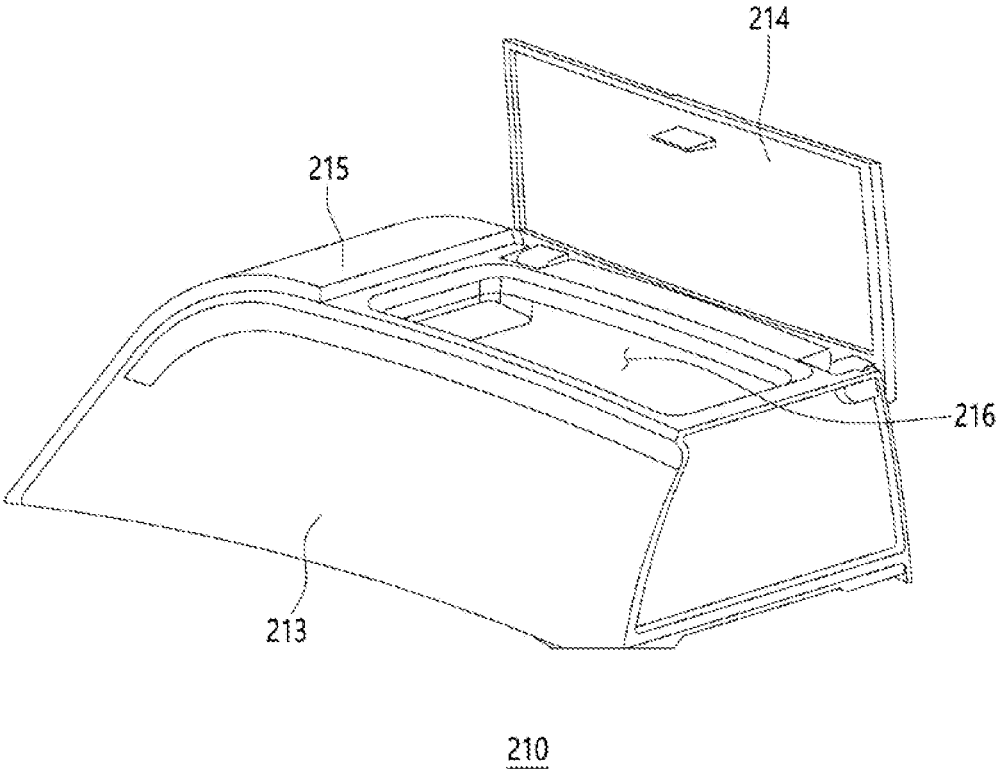

【Figure 8】
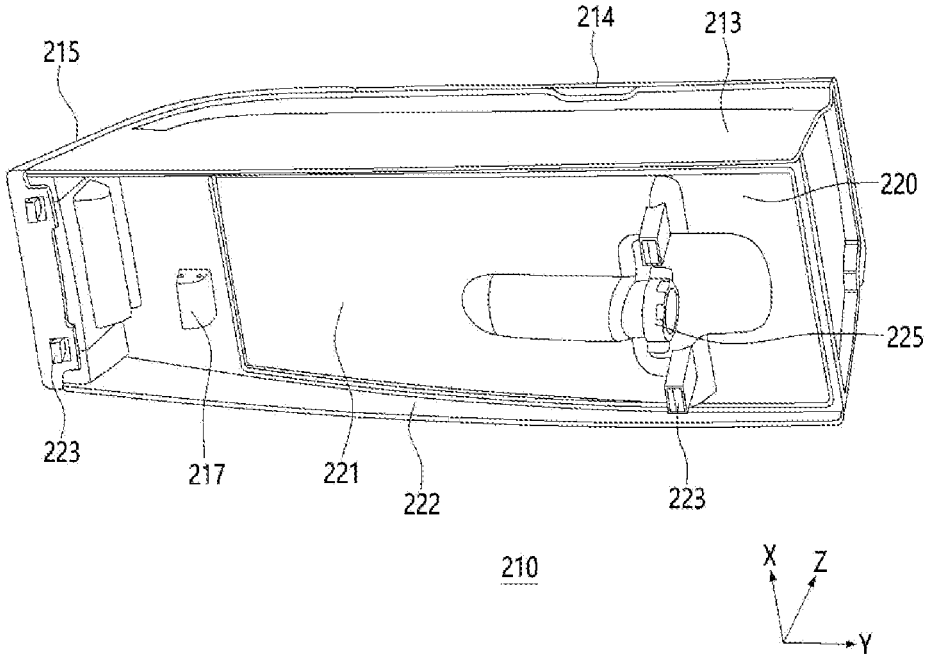

【Figure 9】
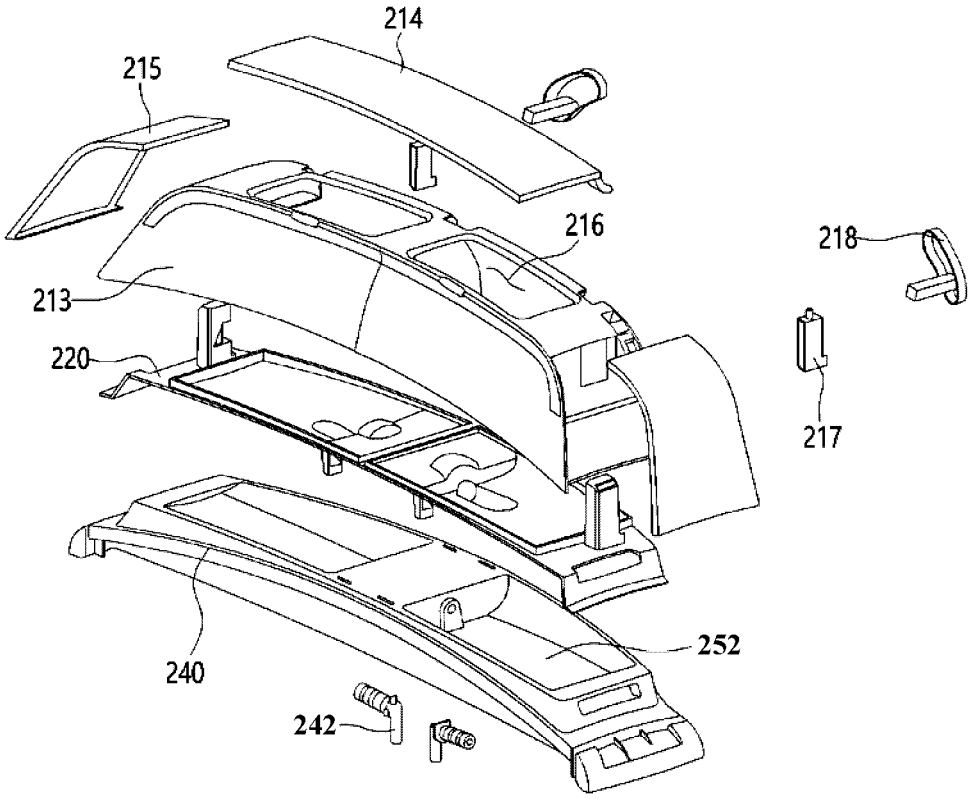
【Figure 10】
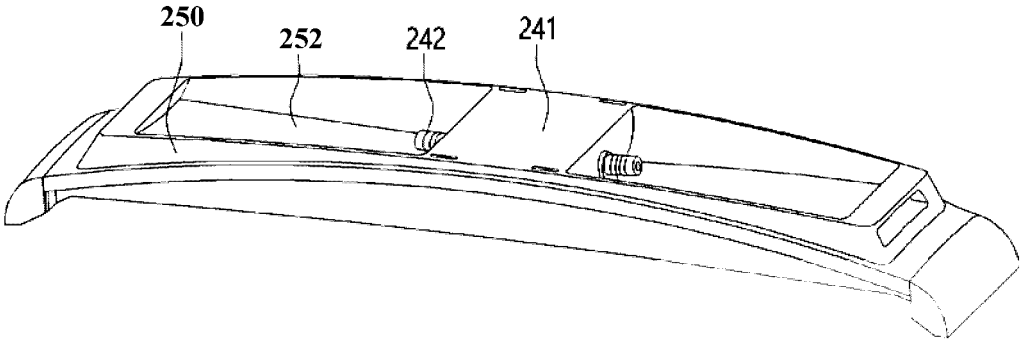
240

【Figure 11】
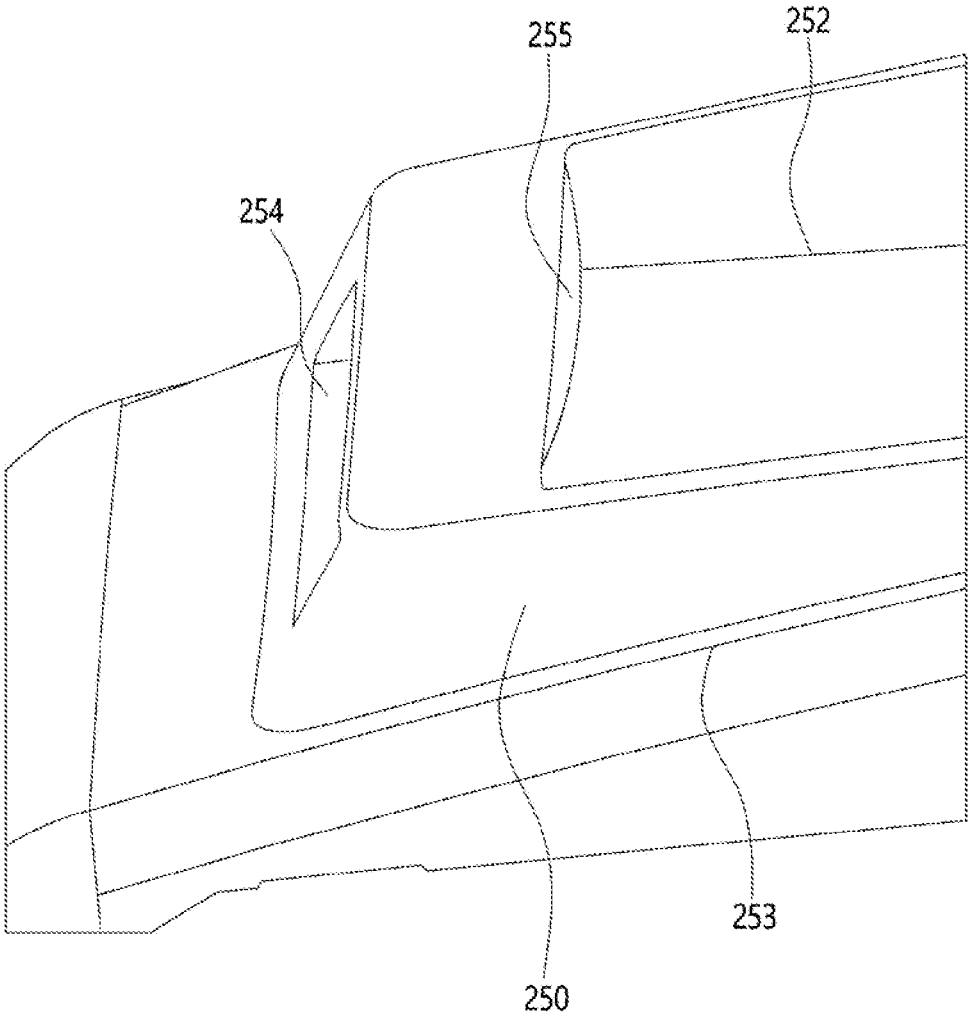

【Figure 12】
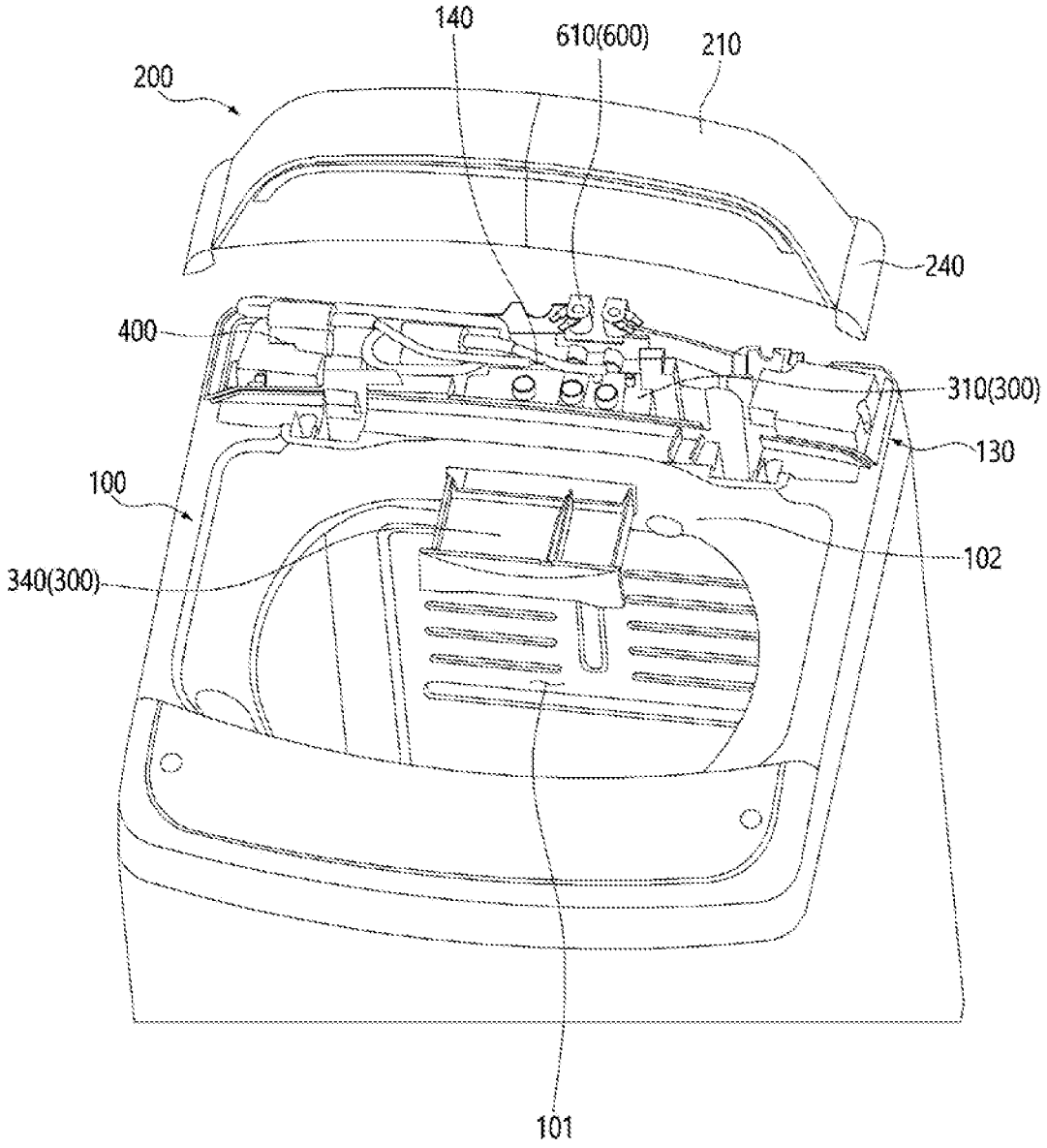

【Figure 13】
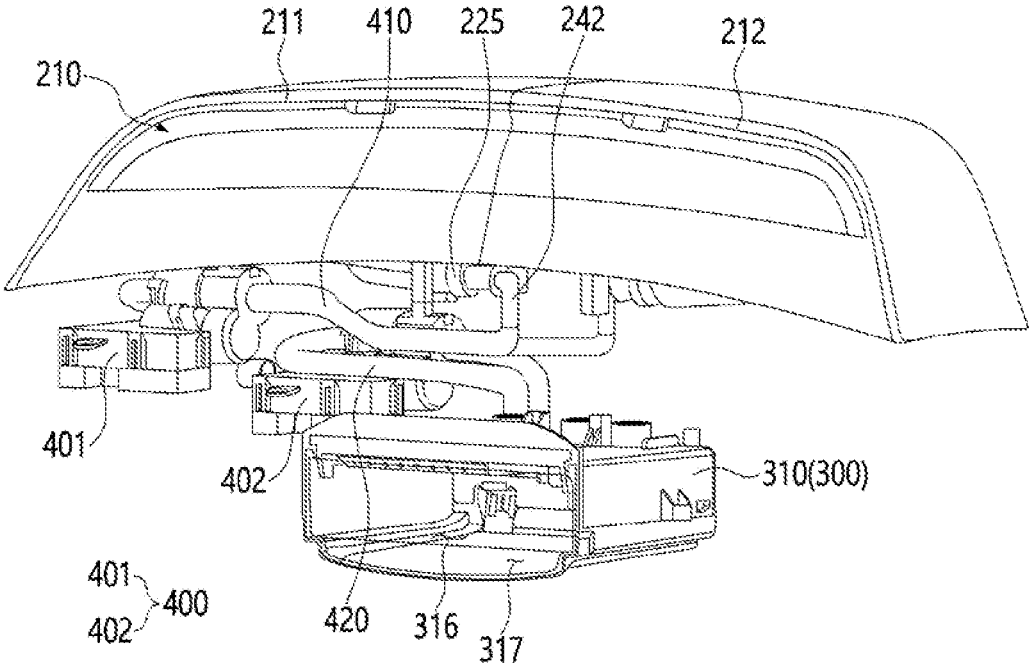

【Figure 14】
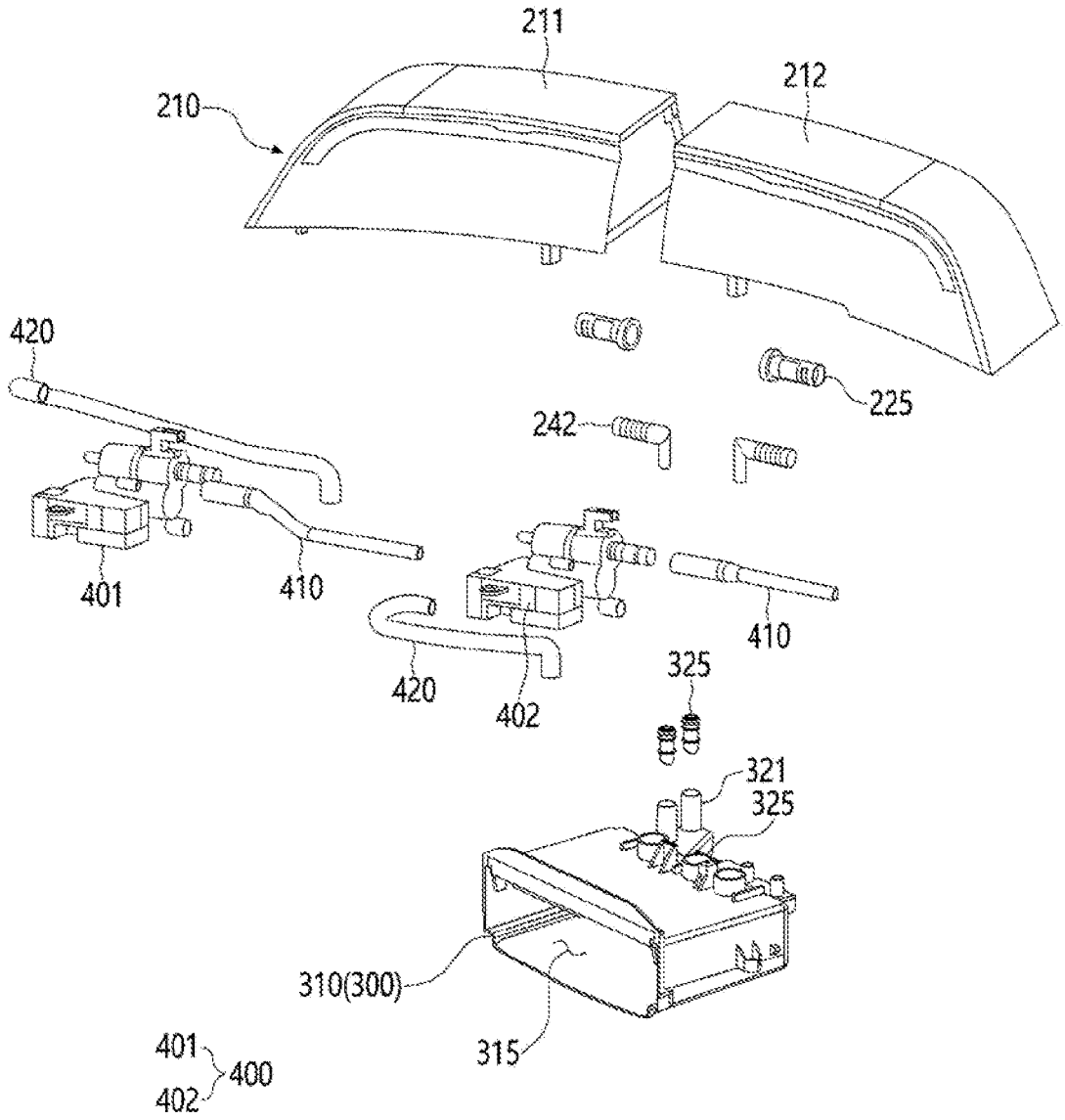

【Figure 15】
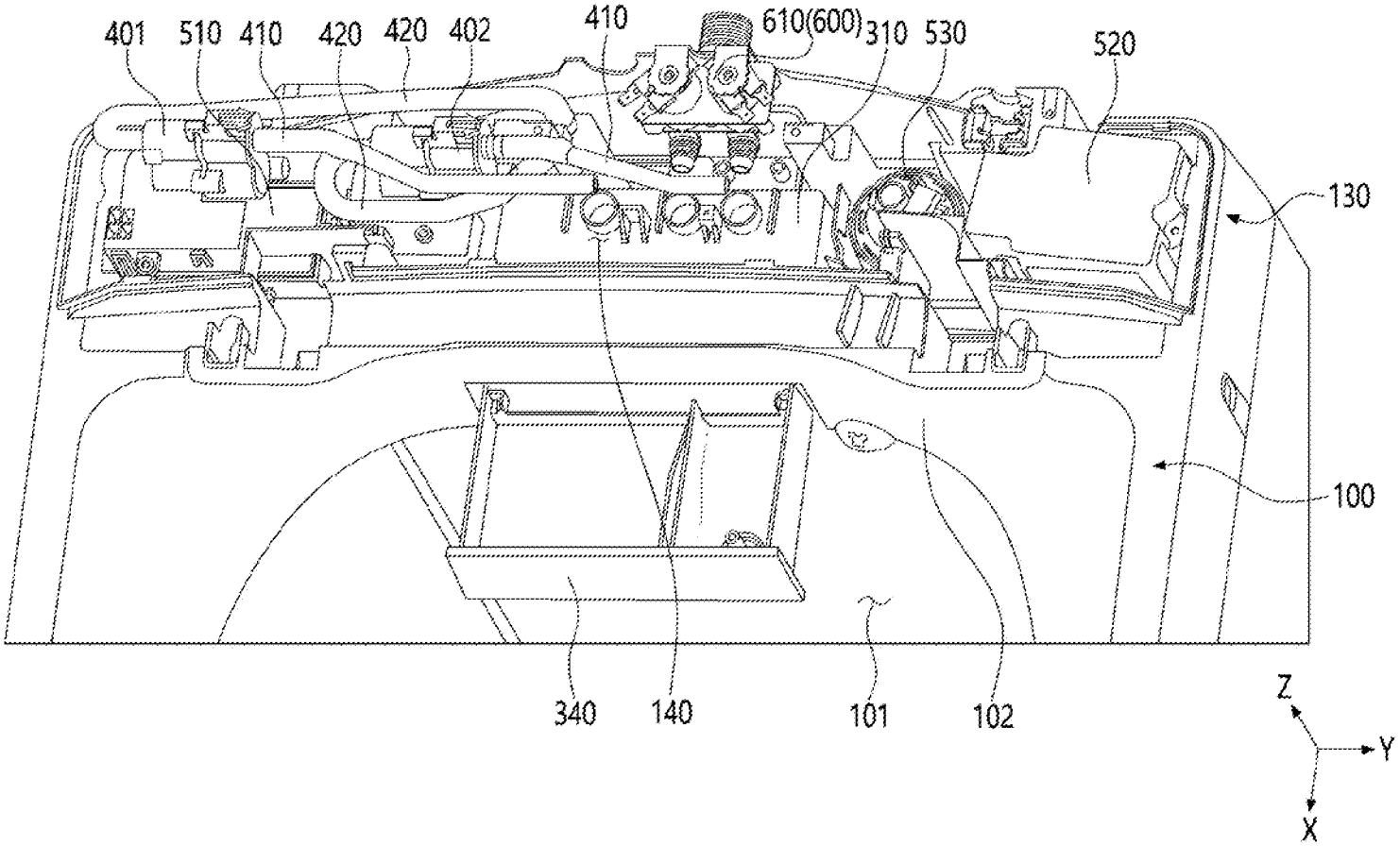

【Figure 16】
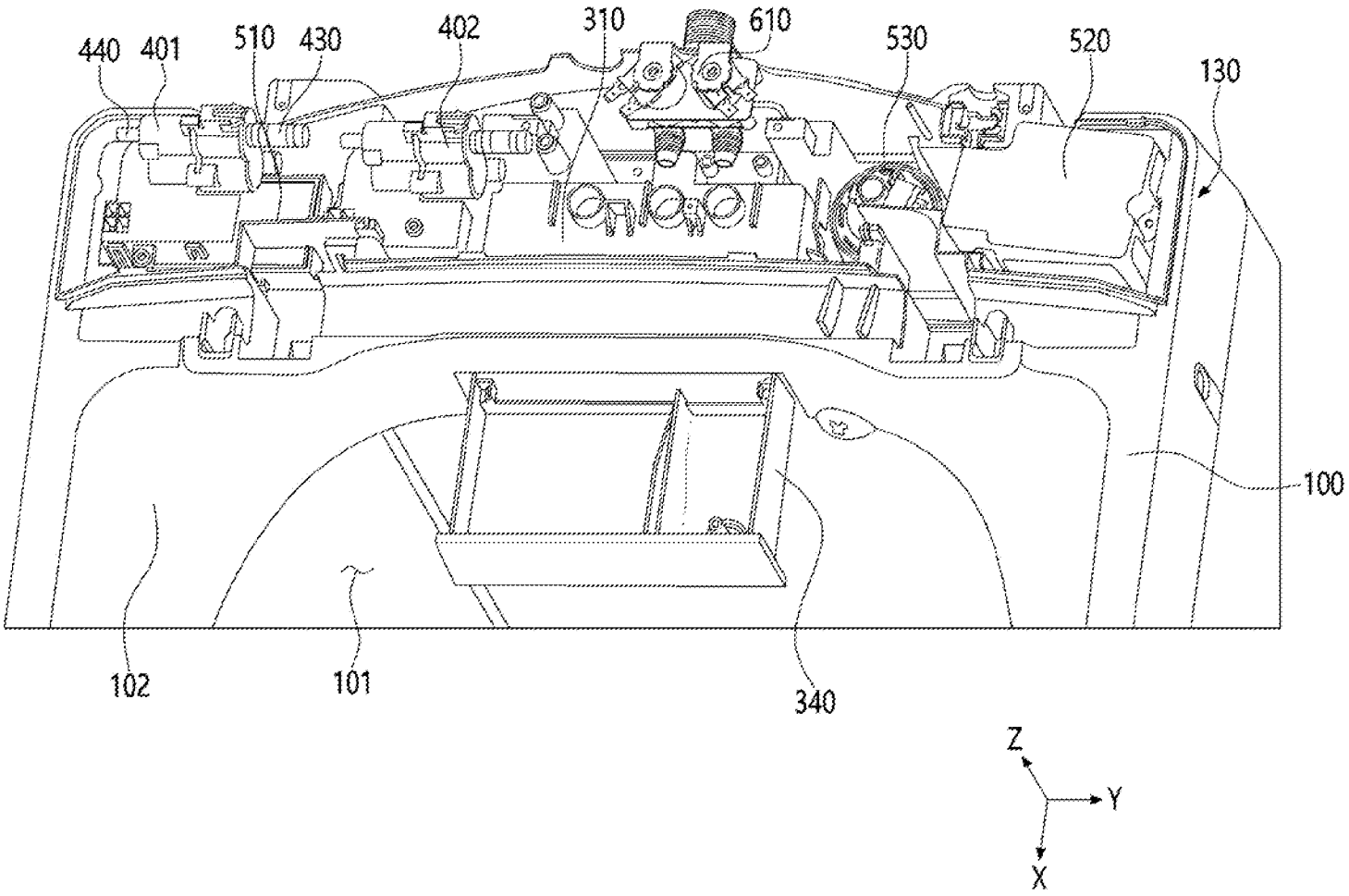

【Figure 17】
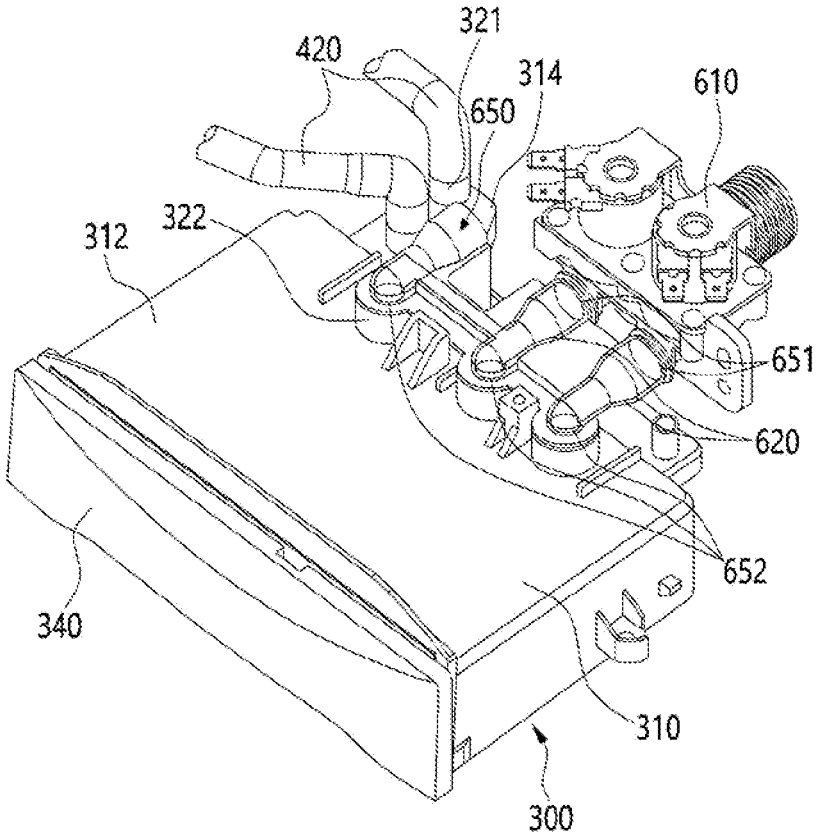

【Figure 18】
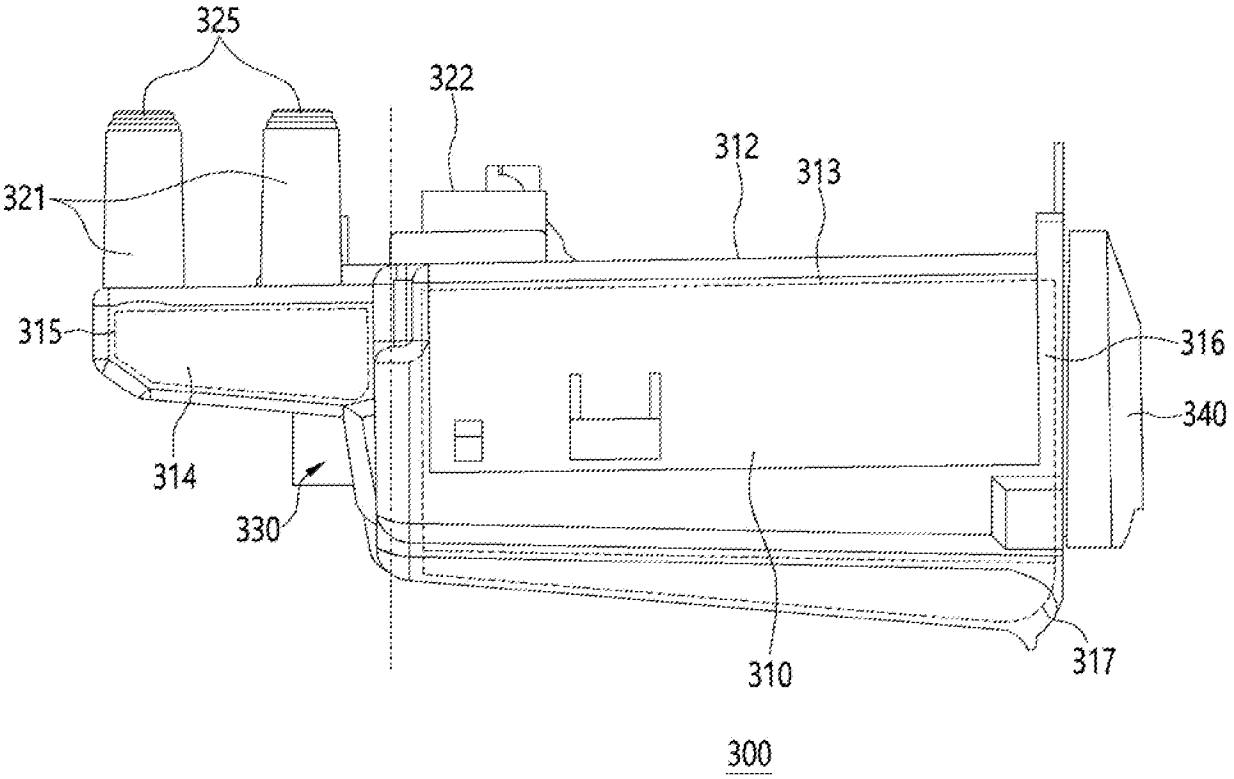

【Figure 19】
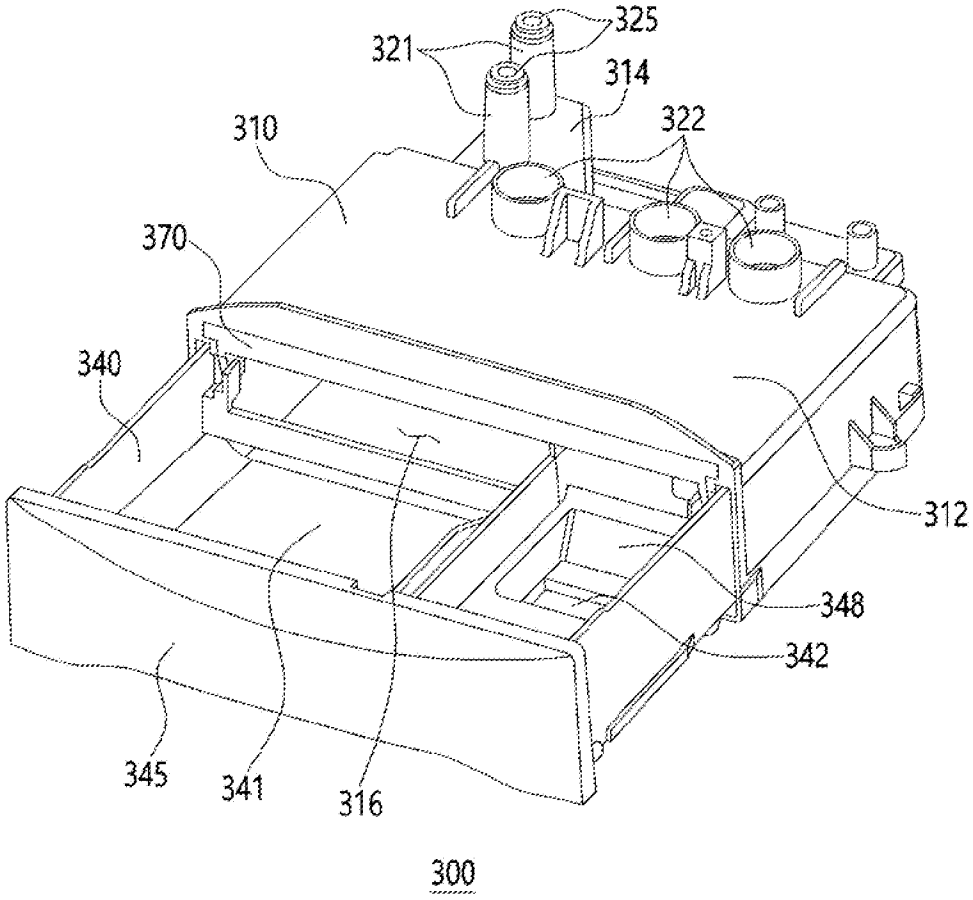

【Figure 20】
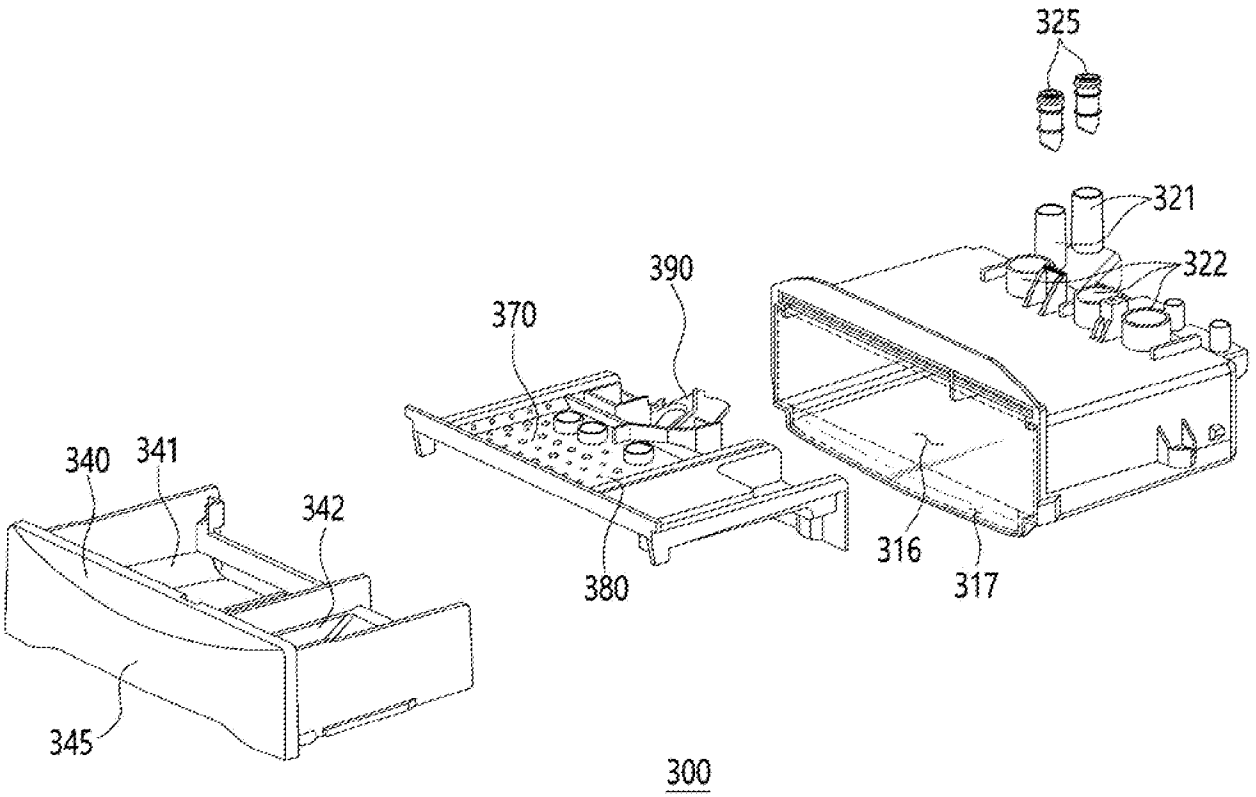

【Figure 21】
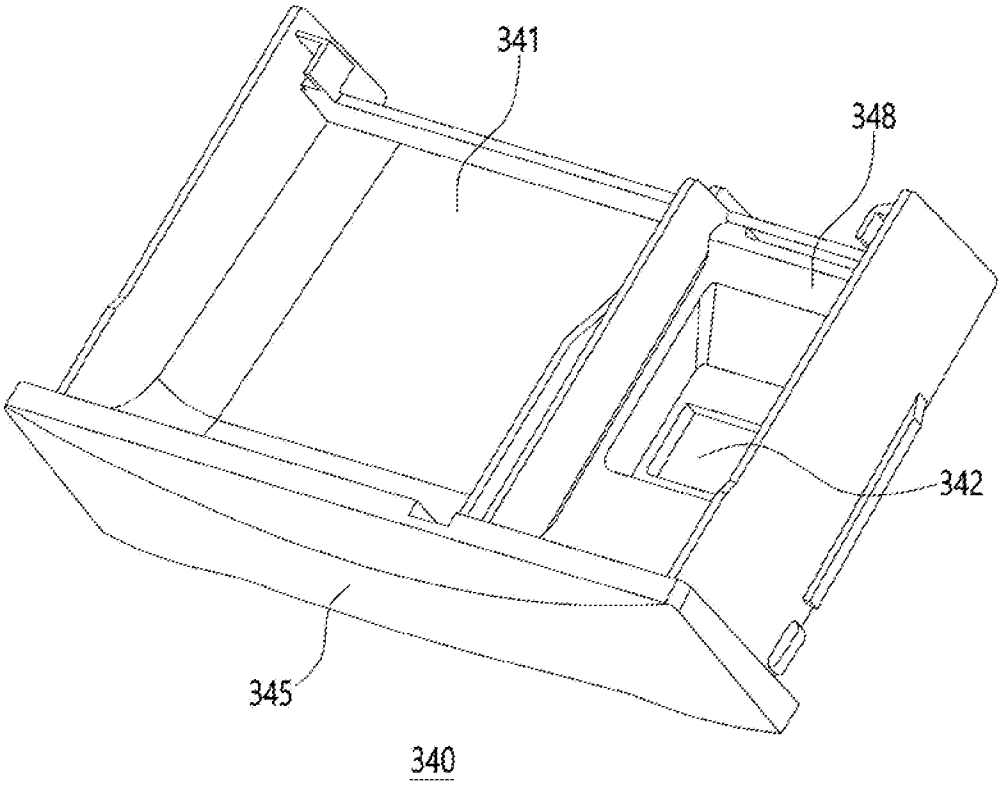

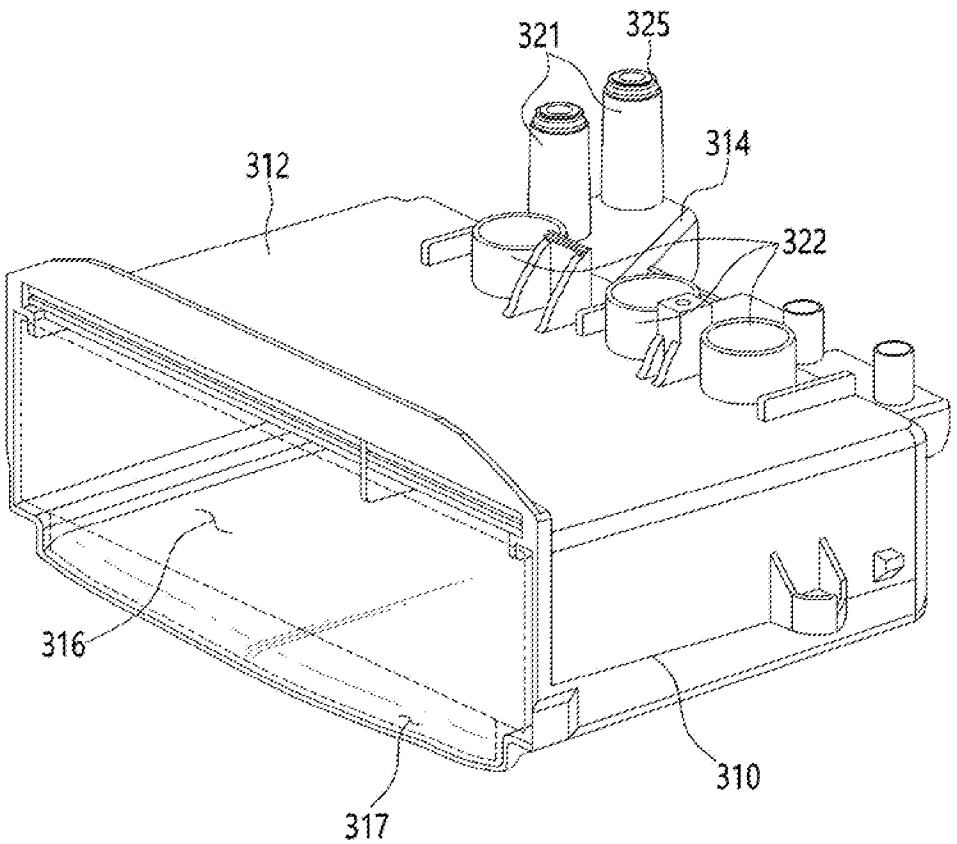
【Figure 22】

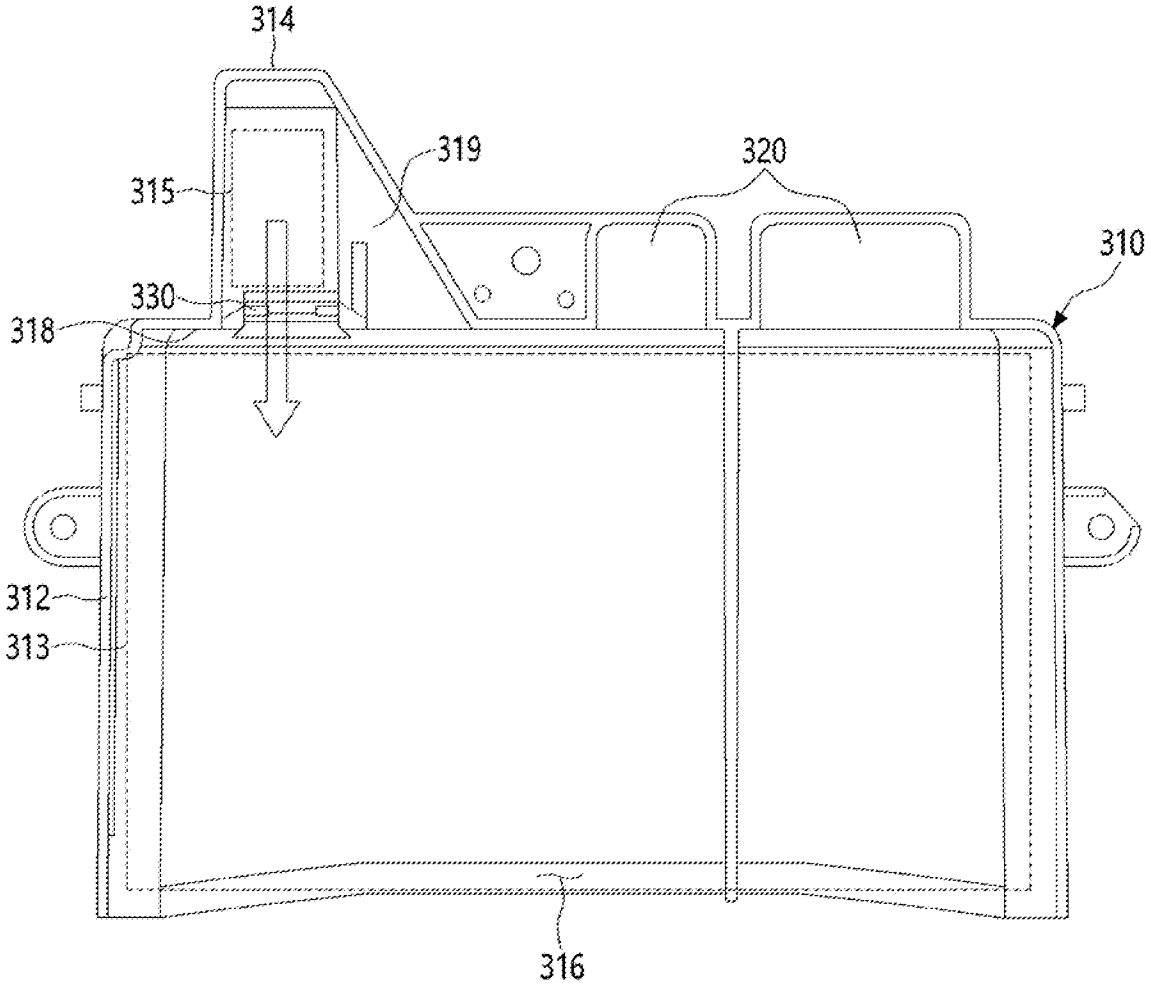
【Figure 23】

【Figure 24】
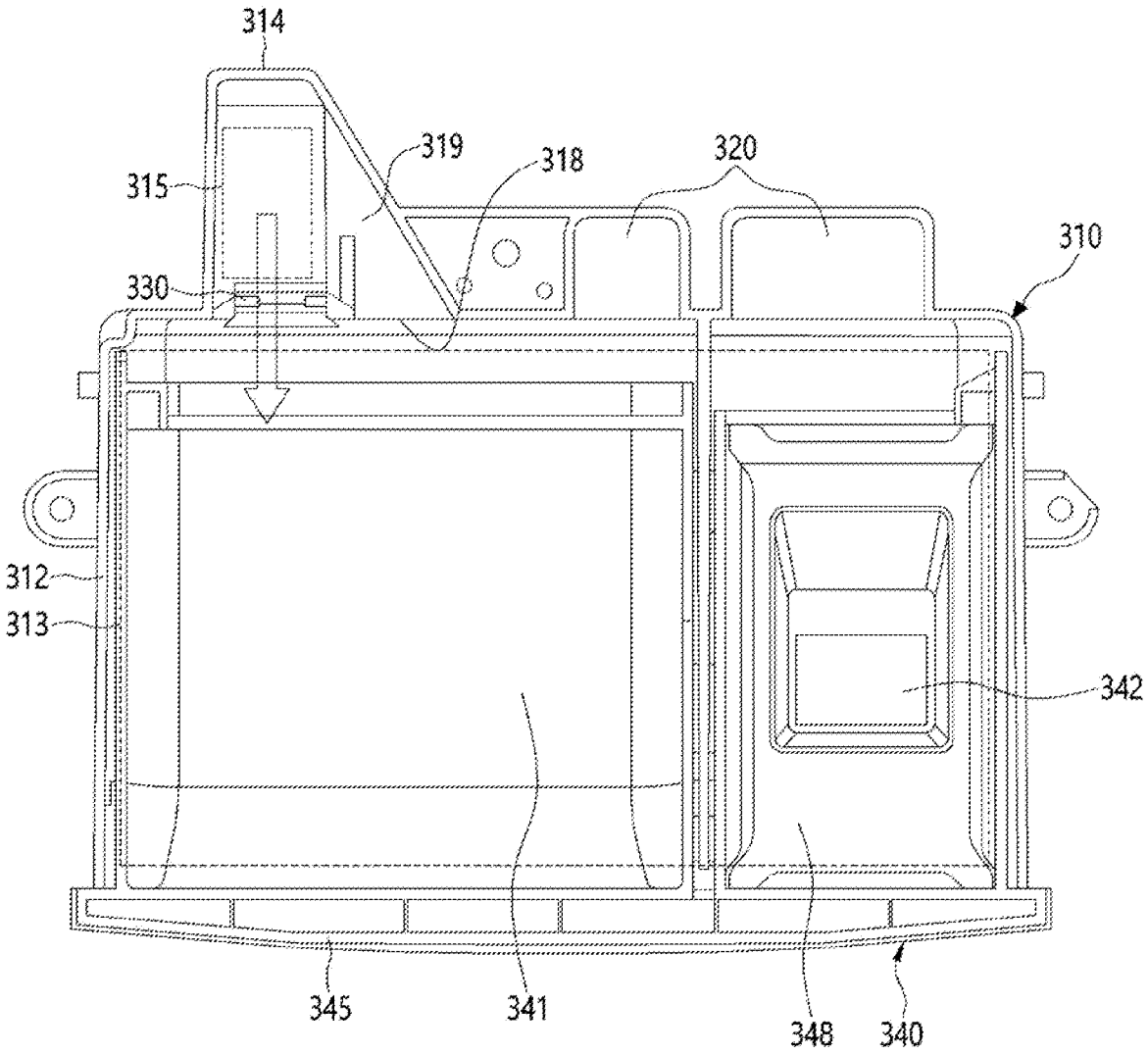

【Figure 25】
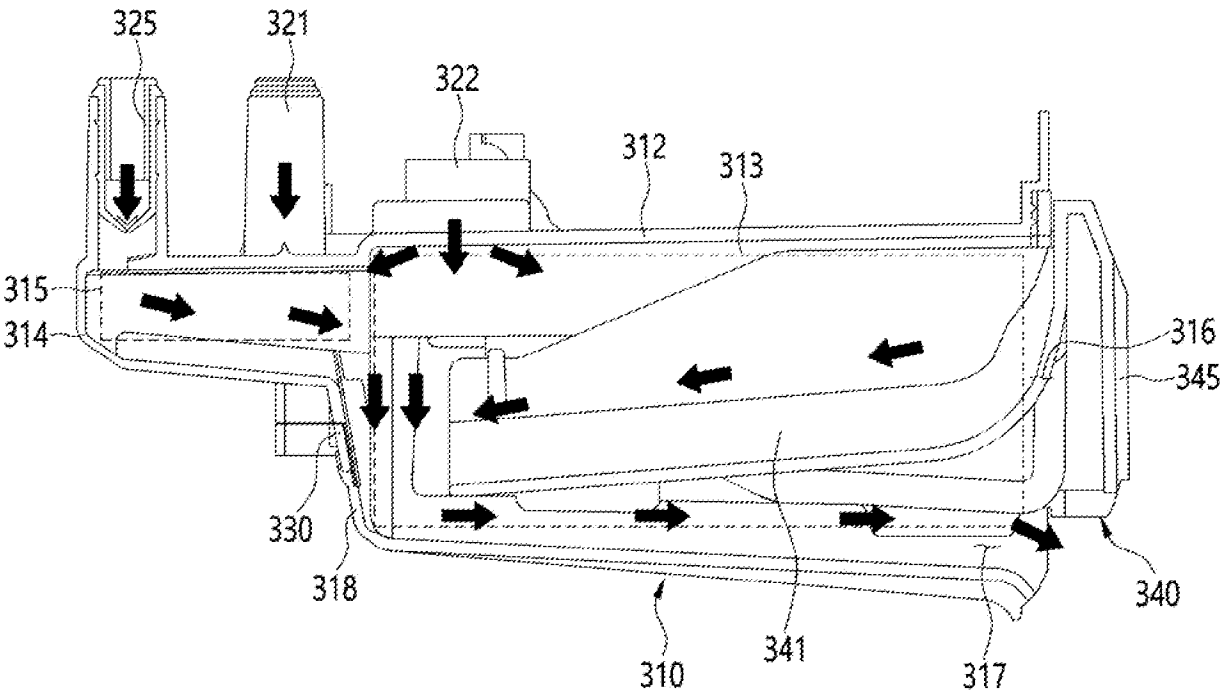

【Figure 26】
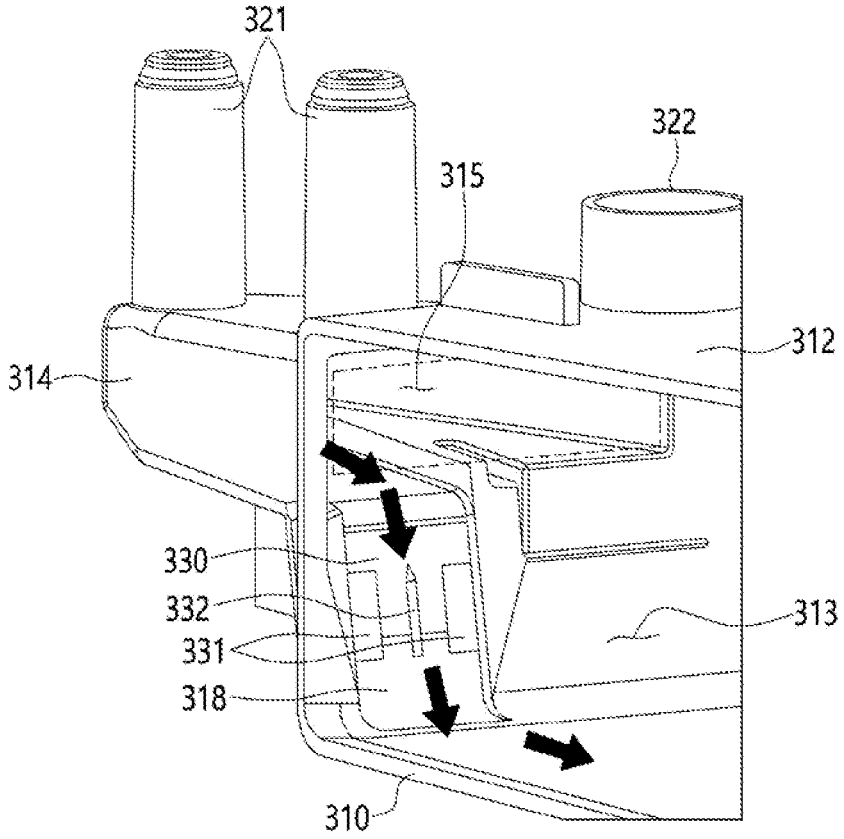

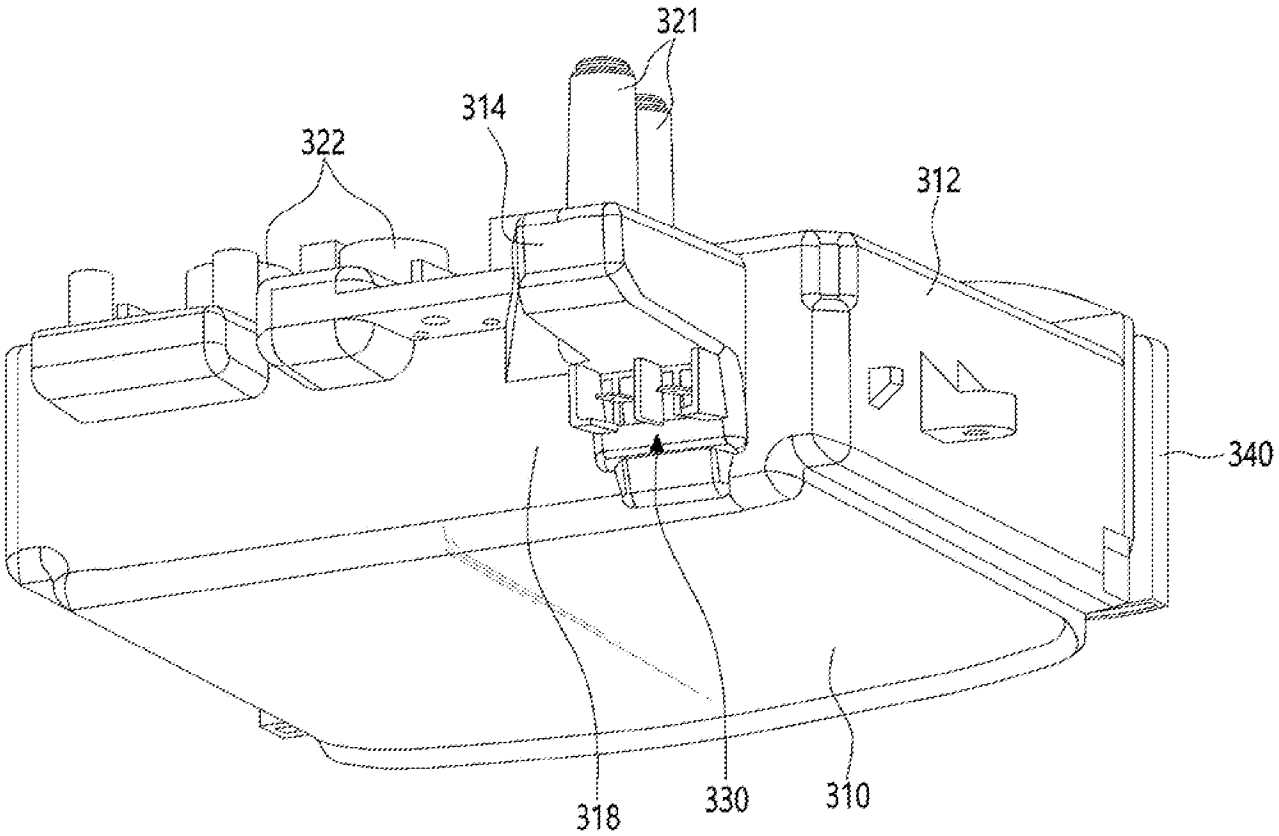
【Figure 27】

【Figure 28】
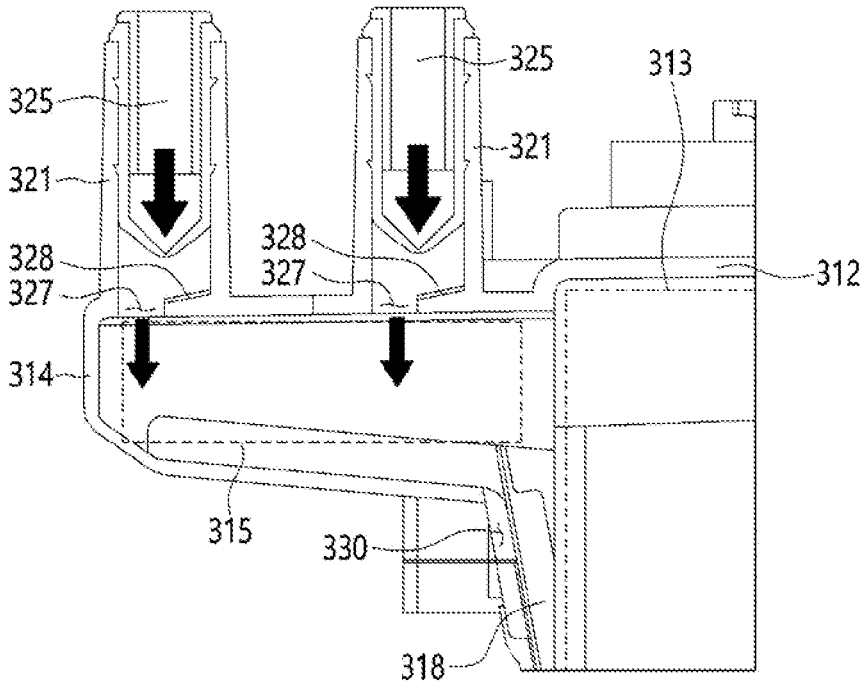
【Figure 29】
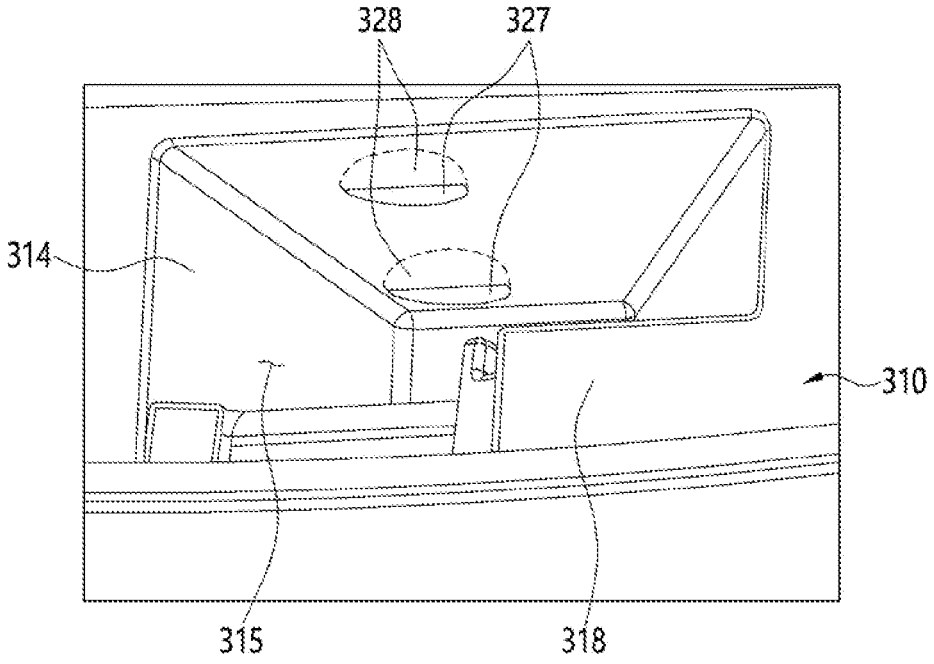

【Figure 30】
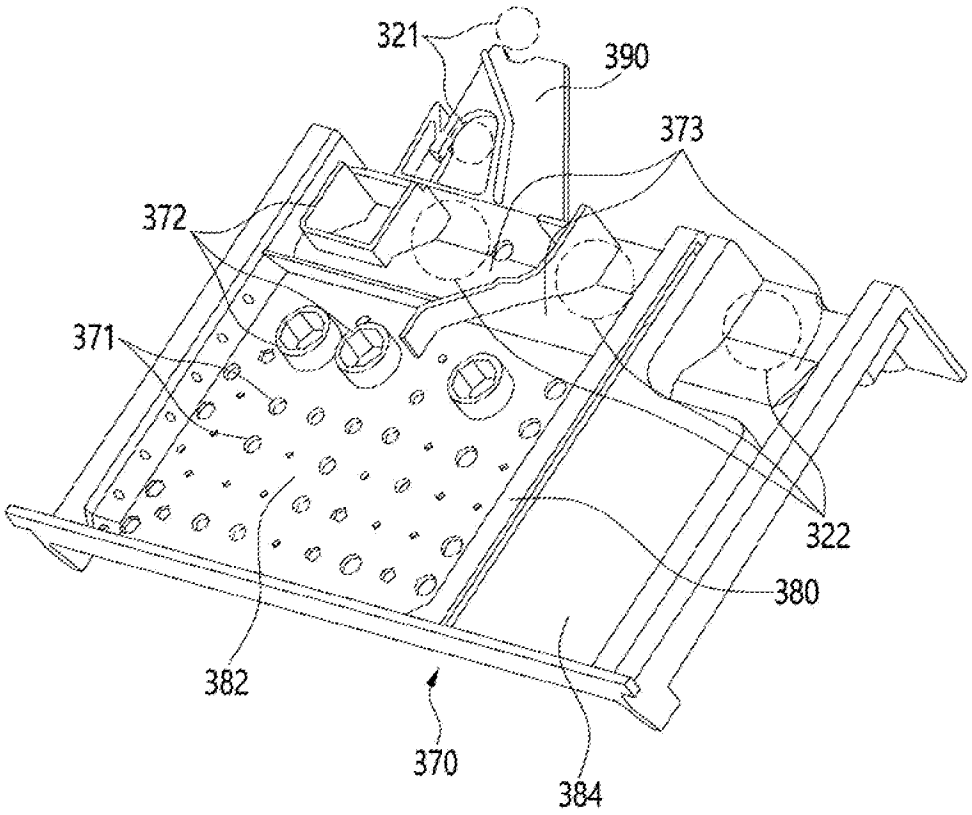

【Figure 31】
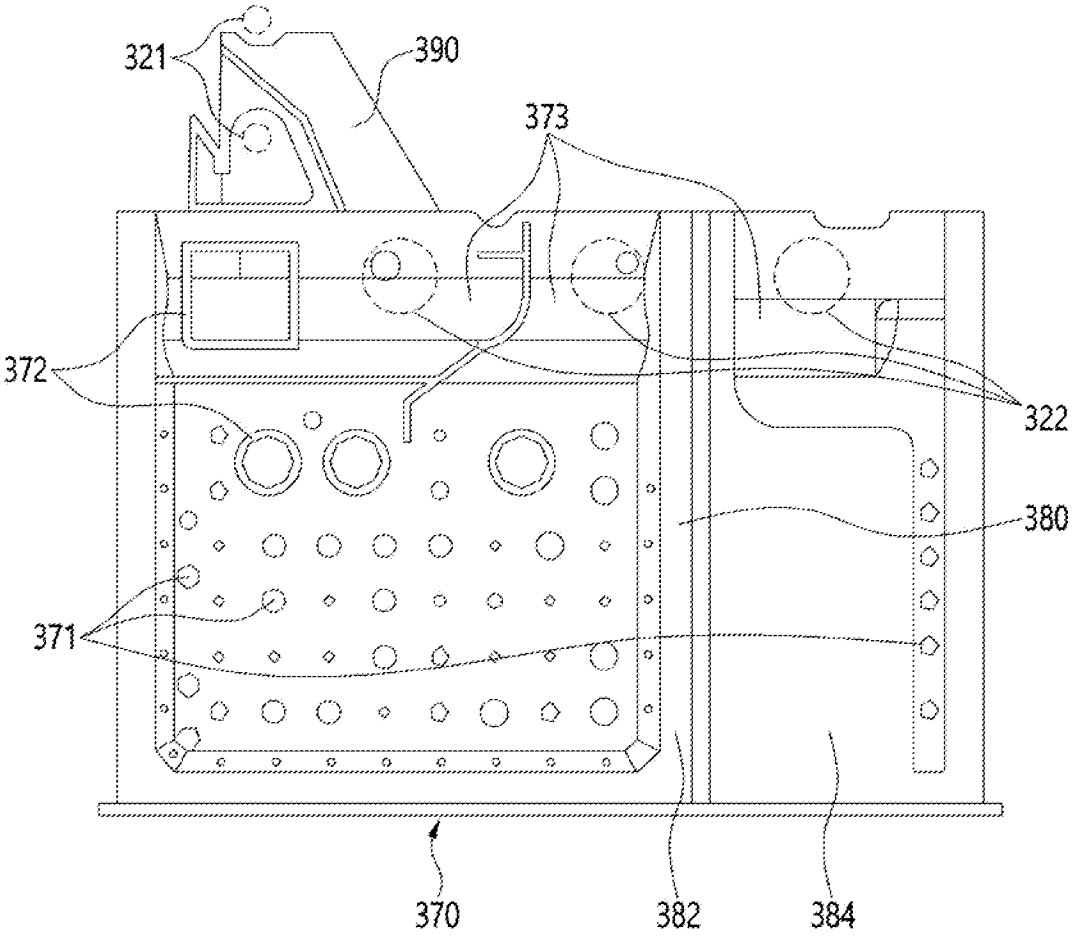

[Figure 32]
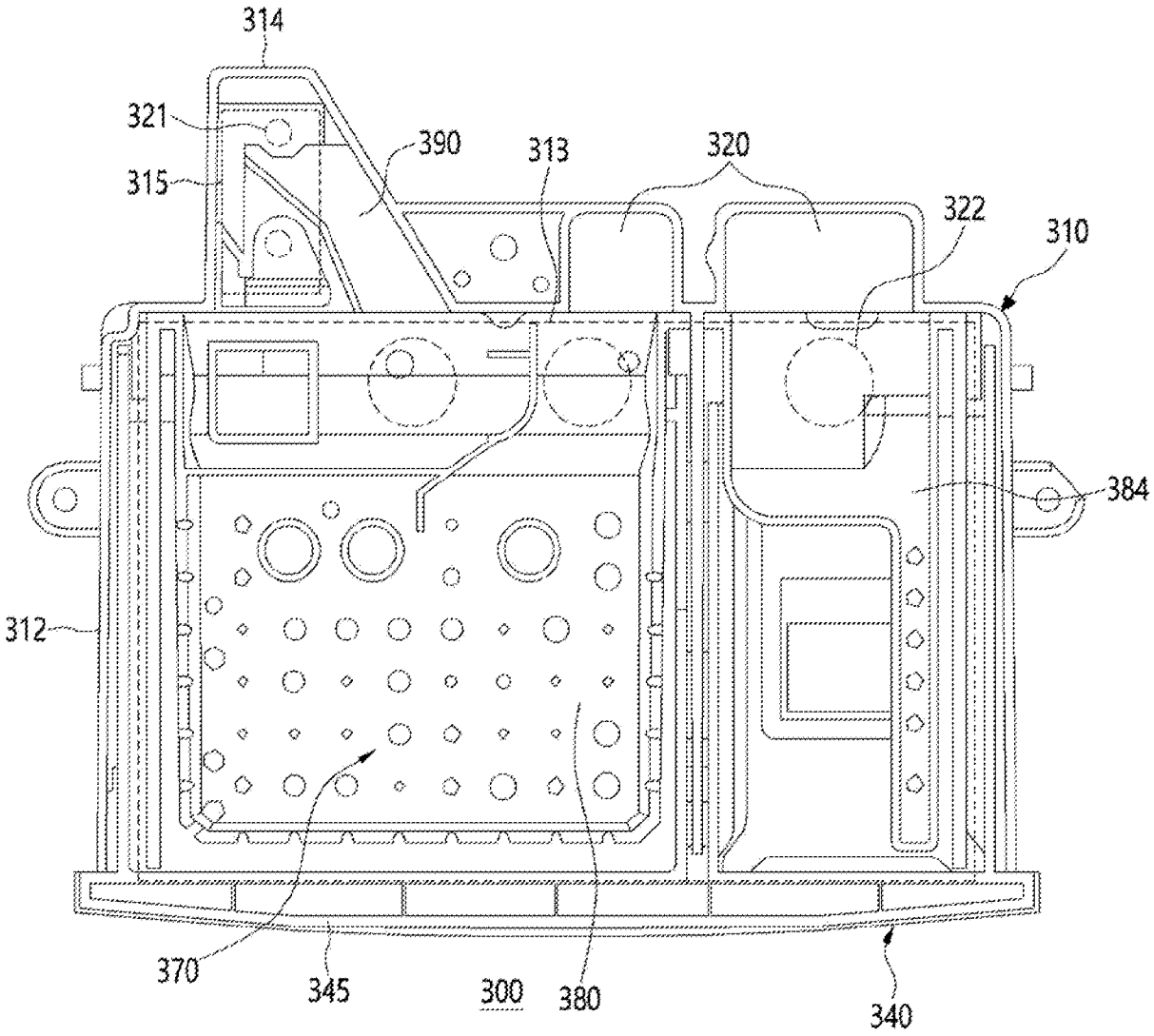

【Figure 33】
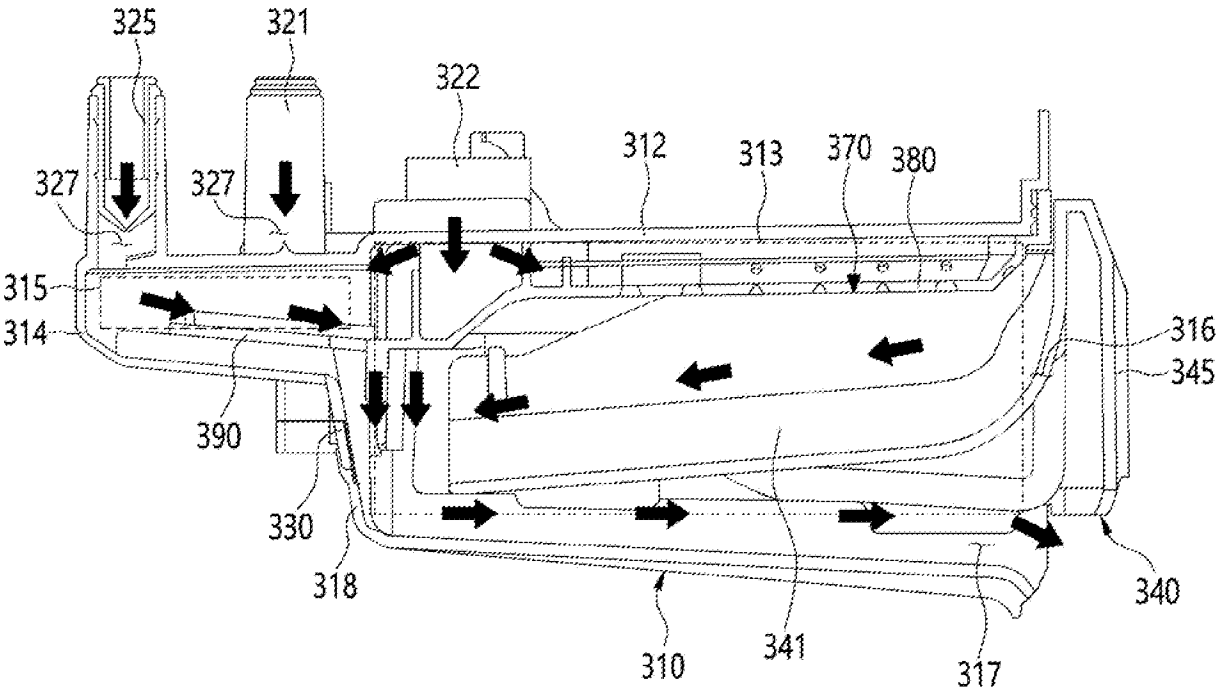

LAUNDRY TREATING APPARATUS

CROSS REFERENCE TO RELATED APPLICATIONS

This application is the National Phase of PCT International Application No. PCT/KR2022/020095, filed on Dec. 12, 2022, which claims the benefit of Patent Application No. 10-2022-0150747, filed in the Republic of Korea on Nov. 11, 2022, all of which are hereby expressly incorporated by reference into the present application.

TECHNICAL FIELD

The present disclosure relates to a laundry treating apparatus, and more particularly, to a laundry treating apparatus including a detergent supply for supplying detergent.

BACKGROUND

A laundry treating apparatus is an apparatus that may perform a washing course to remove contaminants from laundry by putting clothes, bedding, and the like (hereinafter, referred to as the laundry) into a drum. In addition to the washing course, the laundry treating apparatus may perform a rinsing course, a dehydration course, a drying course, and the like.

The laundry treating apparatus may include a cabinet that forms an outer appearance of the apparatus, a tub disposed inside the cabinet, and a drum that is rotatably disposed inside the tub and accommodates the laundry therein.

The laundry treating apparatus may include a detergent supply that injects detergent into the tub or the drum to perform the washing course or the like. When the drum rotates while washing water and the detergent are supplied into the tub, the contaminants may be removed from the laundry because of friction between the laundry and the drum, the washing water, and the like.

The detergent supply may have a detergent supply function to improve a washing effect. In this regard, the detergent may include any substance that enhances the washing effect, such as a laundry detergent that induces decomposition and removal of the contaminants, a softener that improves flexibility of laundry fabric, and a bleaching agent that reduces color contamination in the laundry. The detergent may be in both powder form and liquid form.

In one example, Korean Patent Application Publication No. 10-2020-0007549 discloses a laundry treating apparatus including an existing detergent supply. The existing detergent supply includes a drawer that may be extended from the cabinet and a detergent flow channel defined in the drawer to guide the detergent to the tub. The existing manual detergent supply described above was a scheme in which the detergent introduced into the detergent channel is supplied to the tub along with water.

However, in the existing manual detergent supply described above, a user directly injects the detergent during each washing course. Therefore, it was difficult to perform fixed amount injection, and there was inconvenience of having the user inject the detergent every time.

To solve such problem, a detergent supply that automatically supplies the detergent for each washing course was developed. Furthermore, a scheme of adding the above-described automatic detergent supply to the laundry treating apparatus equipped with the existing manual detergent supply to allow the user to select any one detergent supply was also developed.

When the automatic detergent supply is additionally installed as above, it is necessary to secure a space for each component of the automatic detergent supply to be installed. However, the laundry treating apparatus with the manual detergent supply and other components installed may have a limitation in a space in which the automatic detergent supply may be installed. To overcome such a problem, a structure of placing a portion of the automatic detergent supply outside the cabinet was developed.

Korean Patent Application Publication No. 10-2020-0120202 discloses a laundry treating apparatus in which a storage bin in which detergent for the automatic detergent supply is stored in the automatic detergent supply is disposed outside the cabinet.

When a manual detergent supply and an automatic detergent supply are provided together as in the laundry treating apparatus, the detergent for the automatic detergent supply may be delivered to the manual detergent supply, and detergent for the manual detergent supply and the detergent for the automatic detergent supply may be discharged into the tub together.

However, when the detergent for the automatic detergent supply is supplied into the manual detergent supply, even when the detergent for the manual detergent supply is not accommodated and only the detergent for the automatic detergent supply is used, the detergent for the automatic detergent supply may scatter inside the manual detergent supply. Further, a problem with cleaning the detergent for the automatic detergent supply may occur in an area in which the detergent for the automatic detergent supply is distributed considering hygiene or the like.

Even when water is supplied into the manual detergent supply, the detergent for the automatic detergent supply may be distributed and remain in an area where cleaning with water is not smooth because of the scattering or the like of the detergent for the automatic detergent supply during the inflow process of the detergent for the automatic detergent supply. In such case, because the cleaning is not smooth, the hygiene may be the problem.

In one example, in the case of the automatic detergent supply that automatically supplies the detergent, a sensor for identifying a remaining amount of the detergent for the automatic detergent supply and whether the detergent for the automatic detergent supply is normally supplied may be disposed. The sensor may, like the laundry treating apparatus as described above, be disposed in the storage bin in which the detergent for the automatic detergent supply is stored, for sensing the detergent for the automatic detergent supply.

However, in the laundry treating apparatus described above, the storage bin in which the detergent for the automatic detergent supply is stored is disposed outside the cabinet, so that a terminal or the like connected to the sensor may be exposed to the outside, and thus contamination or damage may easily occur, which may cause a failure or a malfunction of the sensor.

Therefore, in the case in which at least a portion of the automatic detergent supply is exposed to the outside of the cabinet, development of a structure in which the sensor for sensing the detergent for the automatic detergent supply is maintained stably and is able to effectively sense the detergent for the automatic detergent supply is an important task in the present technical field.

SUMMARY

Technical Problem

Embodiments of the present disclosure are to provide a laundry treating apparatus having a structure in which an automatic detergent supply is efficiently installed.

In addition, embodiments of the present disclosure are to provide a laundry treating apparatus in which detergent for an automatic detergent supply may be delivered to a manual detergent supply and may be effectively discharged together with detergent for the manual detergent supply.

In addition, embodiments of the present disclosure are to provide a laundry treating apparatus that may improve manageability by effectively limiting a distributed area of detergent for an automatic detergent supply in a manual detergent supply.

In addition, embodiments of the present disclosure are to provide a laundry treating apparatus that may effectively suppress contamination or damage to a detector that detects detergent for an automatic detergent supply.

In addition, embodiments of the present disclosure are to provide a laundry treating apparatus that may effectively sense detergent for an automatic detergent supply in a manual detergent supply.

In addition, embodiments of the present disclosure are to provide a laundry treating apparatus that may efficiently provide water to a detergent supply.

In addition, embodiments of the present disclosure are to provide a laundry treating apparatus that may effectively increase a water supply area in a detergent supply.

In addition, embodiments of the present disclosure are to provide a laundry treating apparatus that may effectively clean the inside of a detergent supply and mix detergent with water.

Technical Solutions

A laundry treating apparatus according to one embodiment of the present disclosure includes a first storage exposed to the outside of a cabinet and a second storage disposed inside the cabinet. The first storage may have a storage body in which detergent is stored outside the cabinet, and the second storage may have a drawer in which the detergent is stored inside the cabinet.

The second storage includes a first chamber and a second chamber. The first chamber contains detergent for a manual detergent supply therein and is in communication with a tub. The second chamber may receive detergent for an automatic detergent supply from the first storage and may be connected to the first chamber. Accordingly, the detergent for the automatic detergent supply in the first storage may be discharged to the tub along with the detergent for the manual detergent supply via the second storage.

A laundry treating apparatus according to one embodiment of the present disclosure as described above includes a cabinet, a tub disposed inside the cabinet and containing water therein, a first storage at least partially exposed to the outside of the cabinet and containing first detergent therein, and a second storage disposed inside the cabinet and containing second detergent therein, wherein the second storage is in communication with the tub.

The second storage may include a first chamber receiving water, containing the second detergent therein, and in communication with the tub, a second chamber connected to the first chamber, wherein the first detergent is introduced into the second chamber, and a water diffuser disposed in the first chamber and extending to the second chamber to deliver water supplied to the first chamber to the second chamber.

A water connection port connected to a water supply pipe where water flows may be disposed on a top surface of the first chamber, and the water diffuser may be disposed under the water connection port and receive water falling from the water connection port.

The water diffuser may include a plurality of water discharge holes, wherein water falls downward through the plurality of water discharge holes. The water diffuser may be disposed to cross a space between top surfaces and bottom surfaces of the first chamber and the second chamber.

The water diffuser may include a first diffuser located inside the first chamber, and a second diffuser extending from the first diffuser and located inside the second chamber.

At least some of water supplied to the first chamber may flow from the first diffuser to the second diffuser, fall downward from the second diffuser, and be supplied into the second chamber.

Some of water supplied to the first chamber may fall toward a bottom surface of the first chamber via the first diffuser, and the remainder may fall toward a bottom surface of the second chamber via the second diffuser.

The water diffuser may further include an inclination forming portion located between the first diffuser and the second diffuser and inclined to guide water from the first diffuser to the second diffuser.

The inclination forming portion may be inclined such that a vertical level thereof is lowered in a direction from the first diffuser to the second diffuser. The second diffuser may include a guide rib extending in a direction away from the first diffuser and guiding water.

The second diffuser may be disposed to cross a space between a top surface and a bottom surface of the second chamber. A top surface of the second chamber may have a detergent discharge hole defined therein allowing the first detergent to be discharged therethrough, and the second diffuser may have an open portion corresponding to the detergent discharge hole.

The first chamber may contain the second detergent therein at a location under the first diffuser, and the first diffuser may include a plurality of water discharge holes allowing water to be discharged downward therethrough.

A drawer where the second detergent is stored may be accommodated inside the first chamber, and the first diffuser may be disposed on the drawer to supply water into the drawer.

At least a portion of the water diffuser may be disposed to cross a space between a top surface and a bottom surface of the first chamber, and the water diffuser may include an overflow preventing portion including a circumferential portion protruding toward the top surface of the first chamber and a hole surrounded by the circumferential portion.

One surface of the first chamber may be open to be in communication with the tub, and a portion of an opposite surface thereof may be open to be in communication with the second chamber. The first detergent in the second chamber may be discharged into the tub via the first chamber.

The second storage may include a step forming portion formed to be stepped between a bottom surface of the first chamber and a bottom surface of the second chamber, and the first detergent may flow toward the first chamber via the step forming portion of the second chamber.

The step forming portion may extend obliquely from the bottom surface of the second chamber toward the bottom surface of the first chamber, and the first detergent in the second chamber may be discharged toward the tub via the bottom surface of the second chamber, the step forming portion, and the bottom surface of the first chamber.

The second storage may include a detergent detector disposed on the step forming portion and sensing the first detergent. The second storage may include a receiving casing including the first chamber and the second chamber, wherein a casing open surface in communication with the tub is defined at a front surface of the receiving casing, and a drawer containing the second detergent therein, wherein the drawer is retracted into the first chamber via the casing open surface.

The receiving casing may include a rear wall located on an opposite side of the casing open surface, and the second chamber may protrude rearward from the rear wall.

The drawer may be spaced apart from the bottom surface of the first chamber to define a detergent discharge area, and the first detergent and the second detergent may flow through the detergent discharge area and may be discharged from the receiving casing.

The cabinet may include a top cover having a laundry inlet defined therein, and the tub may have a tub inlet defined therein facing the laundry inlet.

The first storage may include a storage body exposed to the outside of the cabinet, attachable to and detachable from the cabinet, and storing the first detergent therein.

Advantageous Effects

The embodiments of the present disclosure may provide the laundry treating apparatus having the structure in which the automatic detergent supply is efficiently installed.

In addition, the embodiments of the present disclosure may provide the laundry treating apparatus in which the detergent for the automatic detergent supply may be delivered to the manual detergent supply and may be effectively discharged together with the detergent for the manual detergent supply.

In addition, the embodiments of the present disclosure may provide the laundry treating apparatus that may improve the manageability by effectively limiting the distributed area of the detergent for the automatic detergent supply in the manual detergent supply.

In addition, the embodiments of the present disclosure may provide the laundry treating apparatus that may effectively suppress the contamination or the damage to the detector that detects the detergent for the automatic detergent supply.

In addition, the embodiments of the present disclosure may provide the laundry treating apparatus that may effectively sense the detergent for the automatic detergent supply in the manual detergent supply.

In addition, the embodiments of the present disclosure may provide the laundry treating apparatus that may efficiently provide water to the detergent supply.

In addition, the embodiments of the present disclosure may provide the laundry treating apparatus that may effectively increase the water supply area in the detergent supply.

In addition, the embodiments of the present disclosure may provide the laundry treating apparatus that may effectively clean the inside of the detergent supply and mix the detergent with water.

BRIEF DESCRIPTION OF THE DRAWINGS

FIG. 1 is a perspective view showing an outer appearance of a laundry treating apparatus according to an embodiment of the present disclosure.

FIG. 2 is a perspective view showing an open state of a door in a laundry treating apparatus in FIG. 1.

FIG. 3 is a cross-sectional view showing the interior of a laundry treating apparatus according to an embodiment of the present disclosure.

FIG. 4 shows a first storage in which a storage body is attached or detached along a height direction in an embodiment of the present disclosure.

FIG. 5 shows a first storage in which a storage body is attached or detached along a width direction in an embodiment of the present disclosure.

FIG. 6 is a perspective view showing an outer appearance of a storage body of a first storage in an embodiment of the present disclosure.

FIG. 7 shows a storage body with a storage cap in an open state in an embodiment of the present disclosure.

FIG. 8 is a bottom perspective view of a storage body in an embodiment of the present disclosure.

FIG. 9 shows an exploded perspective view of a first storage in an embodiment of the present disclosure.

FIG. 10 shows a mounting portion of a first storage in an embodiment of the present disclosure.

FIG. 11 shows a hook groove of a mounting portion in an embodiment of the present disclosure.

FIG. 12 shows the inside of a cabinet from which a mounting portion is removed in an embodiment of the present disclosure.

FIG. 13 shows a structure of connection between a first storage and a second storage in an embodiment of the present disclosure.

FIG. 14 shows a state in which a structure of connection between a first storage and a second storage is disassembled in an embodiment of the present disclosure.

FIG. 15 is a diagram showing a detergent pump and a second storage disposed inside a cabinet in an embodiment of the present disclosure.

FIG. 16 is a diagram showing a state in which a detergent pipe is removed from a detergent pump and a second storage in FIG. 14.

FIG. 17 is a perspective view showing a second storage of a laundry treating apparatus according to an embodiment of the present disclosure.

FIG. 18 is a side view showing a second storage of a laundry treating apparatus according to an embodiment of the present disclosure.

FIG. 19 is a perspective view showing a state in which a drawer is extended from a second storage of a laundry treating apparatus according to an embodiment of the present disclosure in FIG. 16.

FIG. 20 is an exploded perspective view of a second storage of a laundry treating apparatus according to an embodiment of the present disclosure.

FIG. 21 is a perspective view showing a drawer of a second storage in an embodiment of the present disclosure.

FIG. 22 is a perspective view showing a receiving casing of a second storage in an embodiment of the present disclosure.

FIG. 23 is a cross-sectional view from above of the inside of a receiving casing of a second storage in an embodiment of the present disclosure.

FIG. 24 is a cross-sectional view from above of the inside of a receiving casing in which a drawer is accommodated in an embodiment of the present disclosure.

FIG. 25 is a cross-sectional view viewed from a width direction of the inside of a receiving casing in which a drawer is accommodated in an embodiment of the present disclosure.

FIG. 26 is a diagram showing a detergent detector disposed in a receiving casing in an embodiment of the present disclosure.

FIG. 27 is a rear perspective view of a rear surface of a receiving casing in an embodiment of the present disclosure.

FIG. 28 is a cross-sectional view showing the inside of a second chamber of a receiving casing in an embodiment of the present disclosure.

FIG. 29 is a diagram showing a detergent discharge hole located in a second chamber of a receiving casing in an embodiment of the present disclosure.

FIG. 30 is a perspective view showing a water diffuser of a second storage in an embodiment of the present disclosure.

FIG. 31 is a top view of a water diffuser of a second storage in an embodiment of the present disclosure.

FIG. 32 is a cross-sectional view from above of the inside of a receiving casing in which a drawer and a water diffuser are arranged in an embodiment of the present disclosure.

FIG. 33 is a cross-sectional view viewed from a width direction of the inside of a receiving casing in which a drawer and a water diffuser are arranged in an embodiment of the present disclosure.

DETAILED DESCRIPTION

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, to clearly describe the present disclosure, components irrelevant to the description are omitted in the drawings. Further, similar reference numerals are assigned to similar components throughout the present document.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

Furthermore, the terminology used herein is for the purpose of describing the specific embodiment of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, herein, the term 'and/or' includes a combination of a plurality of listed items or any of the plurality of listed items. Herein. 'A or B' may include 'A', 'B', or 'both A and B'.

FIG. 1 shows an outer appearance of a laundry treating apparatus according to an embodiment of the present disclosure, and FIG. 2 shows a state in which a door 110 is opened in the laundry treating apparatus in FIG. 1.

Referring to FIGS. 1 and 2, the laundry treating apparatus according to one embodiment of the present disclosure includes a cabinet 10. The cabinet 10 may have a space defined therein and may be formed approximately in a shape of a pillar.

The cabinet 10 may include a top cover 100 having a laundry inlet 101 defined therein and a cabinet body 15. The cabinet body 15 may define therein a space inside which a tub 20, a drum 30, and the like are disposed, and have an open top surface.

The cabinet body 15 may include a plurality of panels, such as a front panel, a rear panel, side panels, and the like, and a base or a bottom panel constituting a bottom thereof, and at least two panels may be molded integrally.

The top cover 100 may form a top surface of the cabinet 10. At least a portion of the top cover 100 may be opened to define the laundry inlet 101 for introducing laundry into the cabinet 10. The top cover 100 may include a cover space 140, which will be described later, and the cover space 140 may correspond to a portion of an internal space of the cabinet 10.

In one embodiment of the present disclosure, the top cover 100 may have the door 110. The door 110 may be pivotable so as to cover the laundry inlet 101. That is, the door 110 may be disposed to open and close the laundry inlet 101.

The cabinet 10 may have a control panel 50. The control panel 50 may include an output unit for providing information to a user and an input unit that is manipulated by the user to generate an input signal.

In one embodiment of the present disclosure, the top cover 100 may include a front portion 120 located in front of the door 110 and a rear portion 130 located at the rear of the door 110. The control panel 50 may be disposed on the front portion 120.

In one example, in one embodiment of the present disclosure, a first storage 200 may be disposed on the rear portion 130 of the top cover 100. The first storage 200 may store first detergent therein and may supply the first detergent into the tub 20 when a washing course or the like of the laundry is performed.

At least a portion of the first storage 200 may be exposed to the outside of the cabinet 10. FIG. 1 shows a state in which a storage body 210, where the first detergent is stored in the first storage 200, protrudes upward from the top cover 100.

In the present disclosure, the inside of the cabinet 10 may be defined as an area that is not exposed to the outside of the cabinet 10. For example, the cover space 140 defined inside the top cover 100 is not exposed to the outside of the cabinet 10 and is able to be understood as a portion of the internal space of the cabinet 10.

The storage body 210 may be exposed to the outside at the rear portion 130 of the top cover 100. The storage body 210 may protrude upward from the rear portion 130 of the top cover 100 and may be detachable from the cabinet 10.

The user may store the first detergent in the storage body 210 while the storage body 210 is coupled to the cabinet 10, or remove the storage body 210 from the cabinet 10 to store the first detergent or wash the storage body 210.

FIG. 3 is a cross-sectional view showing the interior of a laundry treating apparatus according to an embodiment of the present disclosure.

Referring to FIG. 3, the tub 20 and the drum 30 may be disposed inside the cabinet 10. The tub 20 may receive water therein and include a tub inlet 22 that opens toward the laundry inlet 101.

In one embodiment of the present disclosure, the laundry inlet 101 may be located in the top cover 100, and the tub inlet 22 of the tub 20 may also be open upward. That is, the laundry treating apparatus according to one embodiment of the present disclosure may be of a top loader-type whose axis is perpendicular to the ground.

The drum 30 may be disposed inside the tub 20. The drum 30 may be rotatably installed inside the tub 20, and may receive the laundry therein. The drum 30 may include a drum inlet 32 open toward the laundry inlet 101.

Accordingly, the laundry input toward the laundry inlet 101 may pass through the tub inlet 22 and the drum inlet 32 and be received inside the drum 30. The tub 20 and the drum 30 may have a cylindrical shape with a space defined therein, and a plurality of communication holes 31 may be defined in a circumferential surface of the drum 30.

When water is stored inside the tub 20, the drum 30 may share water with the tub 20 by allowing water in the tub 20 to flow thereinto through the communication holes 31.

In one example, in one embodiment of the present disclosure, the first storage 200 and a second storage 300 may be disposed at an upper portion of the cabinet 10. The top cover 100 may have the cover space 140 defined inside the rear portion 130 located at the rear of the door 110.

The top cover 100 may be opened to expose the cover space 140 upward, and the first storage 200 may include a mounting portion 240 disposed to cover an open surface of the cover space 140. The first storage 200 may include the storage body 210 in which the first detergent is stored, and the storage body 210 may be mounted on the mounting portion 240 on the top cover 100.

The second storage 300 may be located in the cover space 140. The first detergent in the first storage 200 may be supplied to the second storage 300. The second storage 300 may accommodate second detergent therein, and the first detergent and the second detergent may be discharged together toward the tub 20.

Additionally, one embodiment of the present disclosure may include a water supply 600 connected to a water supply source outside the cabinet 10, and the second storage 300 may receive water from the water supply 600. Accordingly, the first detergent and the second detergent may be mixed with water in the second storage 300 and then discharged into the tub 20.

One embodiment of the present disclosure includes a driver 40. The driver 40 may be located beneath the tub 20 and may be connected to the drum 30 via a driving shaft that extends through the tub 20. In other words, the drum 30 may receive a rotational force from the driver 40 via the driving shaft inside the tub 20.

A rotator 35 may be disposed on a bottom of the drum 30. The rotator 35 may cover at least a portion of a bottom surface of the drum 30 from above, and may rotate together with the drum 30 or independently of the drum 30.

The rotator 35 may be connected to the driver 40. The driver 40 may include a transmission or the like, and the driving shaft may include a solid shaft and a hollow shaft connected to the transmission. One of the solid shaft and the hollow shaft may be connected to the drum 30, and the other may be connected to the rotator 35.

In one example, a suspension 25 to support the tub 20 to the cabinet 10 may be disposed inside the cabinet 10. The suspension 25 may include an elastic body or the like and may reduce vibration transmitted from the tub 20.

Accordingly, the vibration generated from the drum 30 or the driver 40 and transmitted via the tub 20 is attenuated via the suspension 25, so that an amount of vibration transmitted to the cabinet 10 may be reduced.

Additionally, a drainage 700 may be connected to tub 20. The washing water containing contaminants as the washing course progresses may be discharged from the tub 20 to the outside of the cabinet 10 via the drainage 700.

In one example, FIG. 4 shows the storage body 210 that is attached to or detached from the cabinet 10 along a height direction Z of the cabinet 10 in an embodiment of the present disclosure, and FIG. 5 shows the storage body 210 that is attached to or detached from the cabinet 10 along a width direction Y of the cabinet 10 in an embodiment of the present disclosure.

Specifically, in one embodiment of the present disclosure, the storage body 210 of the first storage 200 may be removable from the cabinet 10. The mounting portion 240 of the first storage 200 may be fixed to the top cover 100, and the storage body 210 may be attached to or detached from the mounting portion 240.

There may be various attachment/detachment schemes of the storage body 210 and there may also be various attachment/detachment directions. For example, the storage body 210 may be removed from the cabinet 10 or coupled to the cabinet 10 along the height direction Z of the cabinet 10.

Additionally, the storage body 210 may be removed from the cabinet 10 or coupled to the cabinet 10 along the width direction Y of the cabinet 10. When the storage body 210 is attached or detached along the width direction Y, the first storage body 211 may be coupled to the cabinet 10, that is, the mounting portion 240, at one side in the width direction Y of the cabinet 10, and the second storage body 212 may be coupled to the mounting portion 240 at the other side in the width direction Y.

In one embodiment of the present disclosure, a wall or the like of a building may be located on both sides of the cabinet 10 in a residential environment of the user, and accordingly, the storage body 210 may be coupled to the cabinet 10 in a vertical direction, so that the storage body 210 may be effectively coupled to the cabinet 10 even when the space is limited on both sides.

In addition, even in the case in which the storage body 210 is coupled along the width direction Y of the cabinet 10, it may be designed that an overall width of the storage body 210 coupled to the cabinet 10 is smaller than an overall width of the cabinet 10.

Additionally, a movement distance in the width direction Y required for the coupling and the removal of the storage 210 may be defined within the overall width of the cabinet 10. That is, in one embodiment of the present disclosure, the storage body 210 may move within the width of the cabinet 10 to be coupled to and be removed from the cabinet 10, so that the space may be effectively utilized.

In one example, FIG. 6 shows the storage body 210 according to an embodiment of the present disclosure, and FIG. 7 shows the storage body 210 with a storage cap 214 in an open state. The storage body 210 may include a space defined therein where the first detergent is stored. The storage body 210 may be exposed to the outside of the cabinet 10, and a detergent injection hole 216 for the detergent to be introduced may be defined in the storage body 210.

The storage body 210 may include a storage main body 213 and the storage cap 214. The storage main body 213 may include a space defined therein where the first detergent is stored, may include the detergent injection hole 216 defined therein, and may form at least a portion of an outer appearance of the storage body 210.

The storage cap 214 may be pivotably disposed on the storage main body 213. The storage cap 214 may close or open the detergent injection hole 216. The storage cap 214 may form a portion of the outer appearance of the storage body 210.

The storage body 210 may include an exterior part 215. The exterior part 215 may be disposed on the storage main body 213 to form a portion of the outer appearance of the storage body 210. The exterior part 215 may be disposed on one surface of the storage main body 213 along with the storage cap 214. In other words, the exterior part 215 and the storage cap 214 may together form the one surface of the storage body 210 and improve completeness of the outer appearance of the storage body 210.

In one example, FIG. 8 is a bottom view of the storage body 210. The storage main body 213 may include a storage bottom 220 that forms a bottom surface of the storage body 210. The storage bottom 220 may be located on the mounting portion 240 and may be supported by the mounting portion 240.

A detergent valve 225 may be disposed on the storage bottom 220. The detergent valve 225 may be in an open or closed state. The detergent valve 225 may allow the inside and the outside of the storage main body 213 to be in communication with each other in the open state. When the storage body 210 is attached or detached along the width direction Y of the cabinet 10, the detergent valve 225 may have a longitudinal direction approximately parallel to the width direction Y.

A bottom inclined portion 221 inclined toward the detergent valve 225 may be formed at at least a portion of the storage bottom 220. The bottom inclined portion 221 may be formed to be inclined downward and may form at least the portion of the storage bottom 220.

The detergent valve 225 may be located at a lowermost end of the storage bottom 220 because of the bottom inclined portion 221. The bottom inclined portion 221 may be inclined closer to the ground in a direction toward a center of the cabinet 10 along the width direction Y of the cabinet 10.

In one example, the storage bottom 220 may include a bottom damper 223 that protrudes downwards toward the mounting portion 240. The bottom damper 223 may be made of a high-friction material such as rubber, or may be a high-elasticity body.

The bottom damper 223 may support the storage body 210 from the mounting portion 240 and eliminate clearance between the storage body 210 and the mounting portion 240.

The storage bottom 220 may have a variable protrusion 217. The variable protrusion 217 may protrude downward from the storage bottom 220, and an amount of protrusion thereof may vary.

For example, the storage body 210 may have a variable button 218 that is at least partially exposed to the outside, and a location of the variable protrusion 217 may vary in association with the variable button 218. The user may change a degree of protrusion of the variable protrusion 217 by manipulating the variable button 218.

Whether the storage body 210 is able to be attached to or detached from the cabinet 10 or the mounting portion 240 may be determined depending on the amount of protrusion of the variable protrusion 217. For example, the variable protrusion 217 may be inserted into the storage body 210 or may protrude to the outside. When the variable protrusion 217 is in the protruding state, the storage body 210 is not able to be mounted on or removed from the cabinet 10. However, when the variable protrusion 217 is inserted into the storage body 210, the storage body 210 is able to be mounted on or removed from the cabinet 10.

The storage body 210 may include a bottom side wall 222. The bottom side wall 222 may extend along a perimeter of the storage bottom 220 and may protrude toward the mounting portion 240. The bottom side walls 222 may be disposed at a front end and a rear end of the storage bottom 220. At least a portion of the storage bottom 220, such as the detergent valve 225, may not be visible from the outside at front and rear portions by the bottom side walls 222.

FIG. 9 shows an exploded perspective view of the first storage 200. With reference to FIG. 9, each component of the first storage 200 will be described as follows.

The first storage 200 may include the storage body 210 and the mounting portion 240. The storage body 210 may be exposed to the outside of the cabinet 10 and may store the first detergent therein. The mounting portion 240 may be fixed to the cabinet 10 and may form a portion of the cabinet 10.

The storage body 210 may include a storage main body 213 inside which a space for storing the first detergent is defined. The storage main body 213 may include the detergent injection hole 216 that allows the inside and the outside to be in communication with each other.

The detergent injection hole 216 may be defined in a top surface of the storage main body 213, and may be opened and closed by the storage cap 214 coupled to the storage main body 213. The exterior part 215 may be disposed in an area excluding the storage cap 214 of the top surface of the storage body 213, and the exterior part 215 and the storage cap 214 may together form one surface of the storage body 210.

The storage bottom 220 may be disposed at a bottom of the storage body 213. The storage bottom 220 may be manufactured separately from the storage body 213 and be disposed to cover an open bottom surface of the storage body 213, or may be molded together with the storage body 213 and correspond to a portion of the storage body 213.

The variable protrusion 217 may be disposed inside the storage body 213 or inside the storage bottom 220. The variable protrusion 217 may protrude downward from the storage bottom 220. The amount of protrusion of the variable protrusion 217 that protrudes downward from the storage bottom 220 may vary.

The storage main body 213 may have the variable button 218 connected to the variable protrusion 217. The location of the variable protrusion 217 may vary depending on an operating state of the variable button 218. The user may manipulate the variable button 218 to be in a first state such that the variable protrusion 217 is located inside the storage bottom 220. When the user manipulates the variable button 218 to be in a second state, the variable protrusion 217 may vary in the location so as to protrude downward from the storage bottom 220.

The mounting portion 240 may be located beneath the storage bottom 220. The mounting portion 240 may include a seating surface 252 on which the bottom inclined portion 221 of the storage bottom 220 is seated. The seating surface 252 may have an inclined shape to correspond to the bottom inclined portion 221.

The mounting portion 240 may include a fastening pipe 242, and the fastening pipe 242 may extend through the seating surface 252 and a portion of the fastening pipe 242 may be disposed on the seating surface 252. The fastening pipe 242 may be inserted into the detergent valve 225 of the storage body 210. The detergent valve 225 may be open when the fastening pipe 242 is inserted thereinto, and may be closed when the fastening pipe 242 is removed therefrom.

FIG. 10 shows an outer appearance of the mounting portion 240 of the first storage 200. The mounting portion 240 may form a top surface of the rear portion 130 of the top cover 100, and the storage body 210 may be coupled thereto.

When the storage body 210 is coupled to the mounting portion 240 along the width direction Y of the cabinet 10, the fastening pipe 242 may extend along the width direction Y of the cabinet 10 on the seating surface 252. Accordingly, the fastening pipe 242 may be inserted into the detergent valve 225 of the storage body 210 that is attached and detached along the width direction Y.

A central portion 241 protruding upward may be disposed at a center of the mounting portion 240 based on the width direction Y. That is, the central portion 241 may have a shape that protrudes upwardly of the seating surface 252. The storage body 210 may include a plurality of storage bodies, and may include the first storage body 211 and the second storage body 212.

The first storage body 211 and the second storage body 212 may move toward the central portion 241 from both sides of the central portion 241 and be mounted on the mounting portion 240. A portion of the storage bottom 220 of the storage body 210 may be located on the central portion 241 and supported by the central portion 241. The fastening pipe 242 may extend through the central portion 241 in the width direction Y of the cabinet 10.

The mounting portion 240 may include a protruding portion 250 that protrudes upward around the seating surface 252. The mounting portion 240 may include a stepped portion 253 that is stepped outwardly of a perimeter of the protruding portion 250. In other words, the seating surface 252 may have a shape that is depressed downwardly of a top surface of the protruding portion 250 in the mounting portion 240.

FIG. 11 shows a hook groove 254 of the mounting portion 240. The hook groove 254 may be located on a side opposite to the central portion 241 described above around the seating surface 252. That is, the hook groove 254 may be defined at each of both ends of the mounting portion 240 in the width direction Y.

Specifically, the mounting portion 240 may include the protruding portion 250 that protrudes upward such that the perimeter thereof is stepped, and the top surface of the protruding portion 250 may be depressed downward to form the seating surface 252 on which the storage bottom 220 of the storage body 210 is seated.

Based on the width direction Y of the cabinet 10, the central portion 241 may be located at one end of the seating surface 252 and a protrusion support surface 255 may be located at the other end of the seating surface 252. The protrusion support surface 255 may correspond to a stepped surface formed between the seating surface 252 and a topmost surface of the protruding portion 250.

The above-described hook groove 254 may be located in an outer side of the protruding portion 250 in the width direction Y. A fastening hook disposed on the storage body 210 may be inserted into the hook groove 254.

The above-described stepped portion 253 may be formed around the protruding portion 250. The stepped portion 253 may include the stepped surface located downwardly of the topmost surface of the protruding portion 250 and located outwardly of the perimeter of the protruding portion 250. That is, the protruding portion 250 may be formed such that the topmost surface and the stepped surface thereof are stepped from each other.

The stepped portion 253 may be defined at least at a front end and a rear end of the perimeter of the protruding portion 250. The bottom side wall 222 of the storage body 210 may be disposed to slide along the width direction Y of the cabinet 10 on the stepped portion 253. That is, the bottom side wall 222 may be located on the stepped surface of the stepped portion 253 and slide, and may be supported by the stepped surface.

In one example, referring to FIGS. 10 and 11, a fastening structure of the storage body 210 to the mounting portion 240 will be described in detail as follows.

First, in a process of mounting the storage body 210 removed from the cabinet 10 back to the cabinet 10, the storage body 210 may be located on the mounting portion 240 and move along the width direction Y of the cabinet 10. In such process, the bottom inclined portion 221 of the storage body 210 may be positioned on the seating surface 252 of the mounting portion 240.

The movement of the storage body 210 in the width direction Y may be restricted by the central portion 241 protruding beyond the seating surface 252 in the mounting portion 240. Additionally, the bottom inclined portion 221 of the storage body 210 may be supported on the seating surface 252, so that a movement thereof toward the ground may be restricted.

In one example, the storage body 210 may be mounted in the state in which the variable button 218 is manipulated and the variable protrusion 217 is inserted into the storage body 210, and the mounting process may be ended as the variable protrusion 217 protrudes downwards from the storage bottom 220 again from the mounting location.

The variable protrusion 217 protruding downward from the storage bottom 220 may have the protrusion support surface 255 located on one side in a lateral direction of the cabinet 10. A movement of the storage body 210 to one side in the lateral direction of the cabinet 10 may be restricted because of a contact relationship between the protrusion support surface 255 and the variable protrusion 217.

In one example, the above-mentioned hook groove 254 may be located at one side of the protruding portion 250 of the mounting portion 240 opposite to the central portion 241, and the hook groove 254 may have a depressed shape along the width direction Y.

The fastening hook of the storage body 210 may be inserted into the hook groove 254 of the protruding portion 250 along the width direction Y during the mounting process of the storage body 210. As the fastening hook is inserted into the hook groove 254, an upward movement of the storage body 210 may be restricted.

Additionally, during the mounting process of the storage body 210, the bottom side wall 222 of the storage body 210 may slide along the stepped portion 253 of the mounting portion 240, and thus the bottom side walls 222 may be respectively disposed in front of and at the rear of the protruding portion 250. Based on a structural relationship in which the protruding portion 250 is located between the bottom side walls 222 located at front and rear sides of the storage body 210, a movement of the storage body 210 in a front and rear direction X may be restricted.

That is, movements of the storage body 210 in the front and rear direction X, the width direction Y, and the height direction Z of the cabinet 10 may be entirely restricted during the mounting process onto the mounting portion 240, so that the storage body 210 may be fixed stably.

In one example. FIG. 12 shows a state in which the storage body 210 and the mounting portion 240 of the first storage 200 are removed from the top cover 100 and thus the cover space 140 of the top cover 100 is exposed to the outside.

The rear portion 130 of the top cover 100 may be located rearward of the door 110 and the laundry inlet 101. The cover space 140 may be defined inside the rear portion 130. The top cover 100 may have the cover space 140 with an open top surface. As the mounting portion 240 is coupled to the open top surface of the cover space 140, the cover space 140 may be closed, and at the same time, the mounting portion 240 may form a portion of the top cover 100.

The first storage 200 may be disposed on the cover space 140, and the second storage 300 may be disposed inside the cover space 140. In addition to the second storage 300, a detergent pump 400 for allowing the first detergent in the first storage 200 to flow and the like may be installed inside the cover space 140.

The top cover 100 may include the laundry inlet 101 described above defined therein. The top cover 100 may include a laundry inlet peripheral surface 102 surrounding the laundry inlet 101. The laundry inlet peripheral surface 102 may be recessed into the cabinet 10.

The second storage 300 may include a drawer 340 that may be extended from the cover space 140. The drawer 340 may extend through the laundry inlet peripheral surface 102 and be exposed to the laundry inlet 101, and may be extended via the laundry inlet 101. In addition to the second storage 300, a connection pipe connected to the fastening pipe 242, the water supply 600, and the like may be disposed in the cover space 140.

In one example, FIG. 13 shows the second storage 300 connected to the first storage 200, and FIG. 14 shows the first storage 200 and the second storage 300 in FIG. 13 disassembled.

Referring to FIGS. 13 and 14, the second storage 300 disposed in the cover space 140 may be located under the first storage 200. For example, the second storage 300 may be located under the storage body 210 and the mounting portion 240.

The first storage 200 located on the cover space 140 may be at least partially exposed to the outside of the cabinet 10 to store the first detergent therein, and the second storage 300 may be disposed inside the cabinet 10, may accommodate the second detergent therein, and may be in communication with the tub 20. The inside of the cabinet 10 may be defined to include the cover space 140.

The second storage 300 may extend through the laundry inlet peripheral surface 102 described above from the cover space 140 and be in communication with the laundry inlet 101. Accordingly, the second storage 300 may be in communication with the inside of the tub 20 via the laundry inlet 101.

The second storage 300 may include a receiving casing 310 disposed in the cover space 140 and in communication with the laundry inlet 101 via the laundry inlet peripheral surface 102, and a space in which the drawer 340 is accommodated may be defined in the receiving casing 310.

One surface of the receiving casing 310 facing the laundry inlet 101 may be open to define a casing open surface. In the laundry inlet peripheral surfaces 102, an area corresponding to the casing open surface may be open such that the inside of the receiving casing 310 and the laundry inlet 101 may be in communication with each other, and the drawer 340 may be retracted into the receiving casing 310 via the casing open surface.

A portion of the casing open surface may define a detergent outflow area through which the second detergent or the like flows out. For example, a lower area of the casing open surface may define the detergent outflow area for the second detergent inside the receiving casing 310 to flow out toward the laundry inlet 101.

One embodiment of the present disclosure may include the detergent pump 400. The detergent pump 400 may be disposed inside the cabinet 10. For example, the detergent pump 400 may be installed in the cover space 140. The detergent pump 400 may be connected to the first storage 200 and may allow the first detergent to flow. In one embodiment of the present disclosure, the first storage 200 may correspond to an automatic detergent supply that is connected to the detergent pump 400 and from which the first detergent is provided into the tub 20 by automatically flowing during washing.

The detergent pump 400 may include a plurality of detergent pumps. As described above, the storage body 210 of the first storage 200 may include the first storage body 211 and the second storage body 212, and the detergent pump 400 may include a first detergent pump 401 connected to the first storage body 211 and a second detergent pump 402 connected to the second storage body 212.

The detergent valve 225 of the storage body 210 may be coupled to the fastening pipe 242 of the mounting portion 240, the fastening pipe 242 may be connected to the detergent pump 400 via an outflow pipe 410 for the first detergent to flow, and the detergent pump 400 may be connected to the second storage 300 via a detergent pipe 420.

The second storage 300 may include a detergent connection port 321 to which the detergent pipe 420 is connected. The detergent connection port 321 may have a connection part 325 that may increase rigidity of the detergent connection port 321 and strengthen the coupling between the detergent pipe 420 and the detergent connection port 321.

The connection part 325 may function as a check valve, and accordingly, fluid that may contain the first detergent, the second detergent, and water may be prevented from flowing back to the detergent pump 400 via the detergent pipe 420 from the second storage 300.

The receiving casing 310 of the second storage 300 may include a water connection port 322 to which a water supply pipe 620 is connected, and the water supply pipe 620 connected to the external water supply source may be connected to the water connection port 322, so that water may be supplied into the second storage 300.

In one embodiment of the present disclosure, flow processes of the first detergent, the second detergent, and water will be described based on each component as follows.

First, the first detergent may be stored inside the storage body 210 of the first storage 200, and the storage body 210 may have the detergent valve 225 that selectively allows the inside and the outside to be in communication with each other. The detergent valve 225 may basically maintain the closed state to prevent the first detergent in the storage body 210 from leaking.

In the process of coupling the storage body 210 to the mounting portion 240 disposed on the cabinet 10, at least a portion of the fastening pipe 242 disposed in the mounting portion 240 may be inserted into or coupled to the detergent valve 225. The detergent valve 225 may be switched to the open state as the fastening pipe 242 is inserted thereinto.

That is, when the storage body 210 is coupled to the mounting portion 240, the fastening pipe 242 of the mounting portion 240 may be inserted into the detergent valve 225 and be in communication with the inside of the storage body 210. One end of the fastening pipe 242 may be inserted into the detergent valve 225, and the other end of the fastening pipe 242 may extend through the mounting portion 240 and be positioned in the cover space 140.

The other end of the fastening pipe 242 may be connected to the outflow pipe 410. The outflow pipe 410 may be disposed in the cover space 140. One end of the outflow pipe 410 may be coupled to the fastening pipe 242, and the other end thereof may be coupled to the detergent pump 400 located in the cover space 140.

Accordingly, the first detergent flowing out from the storage body 210 via the detergent valve 225 may be supplied to the detergent pump 400 through the fastening pipe 242 and the outflow pipe 410. Such flow of the first detergent may be generated by the detergent pump 400.

The detergent pump 400 may be located under the first storage 200 and connected to the storage body 210 via the outflow pipe 410, and may be controlled by a controller or the like in a situation in which the flow of the first detergent is required, such as the washing course, and may allow the first detergent to flow.

The detergent pump 400 may be connected to the second storage 300 via the detergent pipe 420 and allow the first detergent to flow into the second storage 300. One end of the detergent pipe 420 may be coupled to the detergent pump 400, and the other end thereof may be coupled to the second storage 300.

The detergent pump 400 may be fixed at various locations. The detergent pump 400 may be disposed inside the cover space 140 and may be located in the width direction Y of the cabinet 10 relative to the second storage 300.

In one embodiment of the present disclosure, the plurality of storage bodies 210 may include the first storage body 211 and the second storage body 212, and the outflow pipe 410 and the detergent pipe 420 may include a pair of outflow pipes and a pair of detergent pipes, respectively, to correspond thereto. In addition, the detergent pump 400 may also include the plurality of detergent pumps, and include the first detergent pump 401 and the second detergent pump 402.

The first detergent flowing out of the first storage body 211 may be supplied to the second storage 300 via the first detergent pump 401, and the first detergent flowing out of the second storage body 212 may be supplied to the second storage 300 via the second detergent pump 402.

That is, in one embodiment of the present disclosure, the first detergent stored in the first storage 200 may be delivered to the second storage 300 by the detergent pump 400, and the first detergent may be supplied into the tub 20 via the second storage 300.

In one example, the receiving casing 310 of the second storage 300 may include a first space 313 for receiving the second detergent therein. The above-described drawer 340 may be accommodated in the first space 313, and the drawer 340 may accommodate the second detergent therein.

The first detergent flowing into the second storage 300 may be mixed with the second detergent and discharged together. Additionally, water supplied to the second storage 300 via the water supply pipe 620 described above may be mixed with the first detergent and/or the second detergent and then supplied to the tub 20.

In one embodiment of the present disclosure, the first detergent in the first storage 200 needs to be diluted with water before being supplied to the tub 20 to prevent a situation in which damage to the laundry occurs as an undiluted solution is provided directly to the laundry.

However, in one embodiment of the present disclosure, the water supply pipe 620 is connected to the second storage 300 for the mixing of the second detergent and water. The first detergent in the first storage 200 may be directly put into the second storage 300 and diluted with water without the separate mixing tank for mixing with water.

Accordingly, even without the separate mixing tank for mixing the first detergent with water, the first detergent may be diluted, and thus, the mixing tank may be effectively omitted. In addition to the mixing tank, the plurality of hoses through which the detergent and water flow may also be omitted, which is advantageous in terms of space utilization and design.

In one example. FIG. 15 shows various components disposed in the cover space 140 according to an embodiment of the present disclosure. In one embodiment of the present disclosure, a flow channel structure of the detergent including the first detergent and the second detergent may be installed inside the cover space 140, and a water supply structure through which water flows may also be installed inside the cover space 140.

In the cover space 140, various components such as a pump control module 510, a PCB module 520, and a water level detector 530 in addition to the detergent pump 400, the second storage 300, and the water supply 600 may be disposed. The components of the cover space are aligned approximately along the width direction Y of the cabinet 10, so that the limited space may be efficiently used.

Furthermore, one embodiment of the present disclosure may include the pump control module 510 for controlling the detergent pump 400, and the pump control module 510 may be aligned with at least one of the plurality of detergent pumps 400 in the vertical direction.

That is, the pump control module 510 may form a stacked structure with one of the plurality of detergent pumps 400, and accordingly, the plurality of detergent pumps 400 and the pump control module 510 may be efficiently disposed on one side in the width direction Y of the second storage 300.

In one example, FIG. 16 shows a state in which the plurality of pipes present in the cover space 140, such as the outflow pipe 410, the detergent pipe 420, the water supply pipe 620, and the like, are removed in an embodiment of the present disclosure.

One embodiment of the present disclosure may include the water level detector 530, and the water level detector 530 may be disposed on the other side of the second storage 300 along the width direction Y. The detergent pump 400 may be disposed on one side of the second storage 300 along the width direction Y, and the water level detector 530 may be disposed on the other side.

The water level detector 530 may detect a level of water stored in the tub 20. The water level detector 530 may be coupled to the top cover 100 so as to be at least partially disposed in the cover space 140, and may detect the water level of the tub 20.

The water level detector 530 may include a head and a detecting body. The head of the water level detector 530 may be disposed in the cover space 140, and the detecting body may extend from the head into the tub 20.

It is advantageous for the water level detector 530 to at least partially extend in the vertical direction to detect the water level of the tub 20, and further, it is advantageous for the water level detector 530 extending in the vertical direction to have the head fixed upward of the tub 20.

Accordingly, the head of the water level detector 530 may be coupled to the top cover 100 located upward of the tub 20 in the cabinet 10, and a space in which the head of the water level detector 530 is disposed may be secured in the cover space 140.

However, to improve space utilization efficiency, because the detergent pump 400 and/or the pump control module 510 may be disposed on one side of the second storage 300 inside the cover space 140, the water level detector 530 may be disposed on the other side of the second storage 300.

In one example, one embodiment of the present disclosure may include the PCB module 520, and the PCB module 520 may be disposed on the other side of the second storage 300 along the width direction Y. The detergent pump 400 may be disposed on one side of the second storage 300 along the width direction Y, and the PCB module 520 including a PCB may be disposed on the other side.

The PCB module 520 may include the PCB and may be connected to the water level detector 530 and/or other sensors. The PCB module 520 may receive sensing values from the plurality of sensors and control the plurality of sensors.

The PCB module 520 may be the main controller described above, or may be a separate control module that is connected to and spaced apart from the main controller. The PCB module 520 may be connected to various components that require electronic control in addition to the plurality of sensors.

In one example, in one embodiment of the present disclosure, the water level detector 530 and the PCB module 520 may be disposed together on the other side in the width direction Y of the second storage 300, and the second storage 300, the water level detector 530, and the PCB module 520 may be aligned along the width direction Y.

Furthermore, the plurality of detergent pumps 400, the second storage 300, the water level detector 530, and the PCB modules 520 described above are aligned together along the width direction Y of the cabinet 10, so that the plurality of components may be efficiently arranged in the cover space 140 located at the rear of the laundry inlet 101.

The pump control module 510 and the PCB module 520, which have a signal connection relationship, that is, require wire connection, may be located at outermost edges of the cover space 140, respectively. That is, the pump control module 510 and the PCB module 520 may be located at ends in the width direction Y of the cover space 140, respectively.

The top cover 100 may include the front portion 120, the rear portion 130, and side portions that connect the front portion 120 with the rear portion 130 on both sides in the width direction Y of the laundry inlet 101. The pump control module 510 and the PCB module 520 are located at the ends in the width direction Y of the cover space 140 so as to be easily connected to the components of the front portion 120 via the side portions using a wire.

For example, the wire may extend from the front portion 120 to the rear portion 130 through the inside of the side portion, and the pump control module 510 and the PCB module 520 may be easily connected to the control panel 50 or the main controller via the wire extending through the side portion.

In one example, FIG. 17 shows the second storage 300 and the water supply 600 connected to each other. The water supply 600 for regulating the flow of water and the receiving casing 310 of the second storage 300 may be connected to each other via the water supply module 650.

The water supply module 650 may be coupled to the water supply valve 610 and the second storage 300 and may deliver water flowing out from the water supply valve 610 to the second storage 300.

The water supply module 650 may include the plurality of water supply pipes 620. That is, at least one water flow channel may be formed inside the water supply module 650. In other words, the water supply module 650 may include one or more water inlet holes 651 and one or more water outlet holes 652.

According to one embodiment of the present disclosure, the water supply valve 610 and the second storage 300 are connected to each other using the water supply module 650 including the one or more water supply pipes 620, so that manageability of the water supply pipe 620 may be improved and durability of the water supply pipe 620 may be secured.

The water inlet hole 651 of the water supply module 650 is connected to the water supply valve 610, so that water may flow into the water inlet hole 651. The water outlet hole 652 of the water supply module 650 is connected to the water connection port 322 of the second storage 300, so that water may flow out of the water outlet hole 652. The plurality of water inlet holes 651 may be connected to the different water supply valves 610, respectively, and the plurality of water outlet holes 652 may be connected to the different water connection ports 322, respectively.

The water supply module 650 may have more water outlet holes 652 through which water flows out to the second storage 300 than the water inlet holes 651 through which water is introduced from the water supply valve 610. That is, the water supply module 650 may have a branching structure in which a flow channel connected to one water inlet hole 651 is branched and connected to a plurality of water outlet holes 652.

The branching structure as described above may be advantageous when there are more targets to receive water than targets to supply water. For example, in one embodiment of the present disclosure, water from the water supply 600 is supplied to the second storage 300, but within the second storage 300, there are a plurality of areas to which water is supplied. Therefore, the water supply module 650 including the branching structure is utilized to achieve efficient supply of water.

In one example, FIG. 18 shows a side view of the second storage 300. The second storage 300 may include the receiving casing 310 and the drawer 340. The receiving casing 310 of the second storage 300 may form an outer appearance of the second storage 300 and may include the detergent connection port 321 and the water connection port 322 described above. The detergent connection port 321 and the water connection port 322 may be disposed on a top surface of the receiving casing 310 to help self-weights of the first detergent and water create flows.

The receiving casing 310 may include the first chamber 312 and the second chamber 314. The second chamber 314 may have a shape that extends or protrudes from the first chamber 312. The first space 313 may be defined inside the first chamber 312, and a second space 315 may be defined inside the second chamber 314.

The first space 313 and the second space 315 may together define an internal space of the receiving casing 310. The drawer 340 that may be extended from the receiving casing 310 may be accommodated in the first space 313 of the first chamber 312. The first detergent may flow into the second space 315 of the second chamber 314.

The first chamber 312 and the second chamber 314 may be in communication with each other. That is, the second space 315 of the second chamber 314 may be in a form expanded from the first space 313 of the first chamber 312. The first detergent supplied to the second chamber 314 may flow to the first chamber 312.

There may be various locations and shapes of the second chamber 314. For example, the second chamber 314 may have a shape protruding rearward from a rear wall 318 of the first chamber 312. The second space 315 may be a space that protrudes rearward from the first space 313.

A bottom surface of the second chamber 314 may be located at a vertical level higher than that of a bottom surface of the first chamber 312. The first detergent provided to the second chamber 314 may create a flow toward the inside of the first chamber 312 because of the vertical level difference between the first chamber 312 and the second chamber 314.

The water connection port 322 may be disposed on the top surface of the first chamber 312, and the detergent connection port 321 may be disposed on the top surface of the second chamber 314. That is, water supplied to the second storage 300 may be provided to the first chamber 312, and the first detergent may be provided to the second chamber 314.

Accordingly, the first detergent may primarily flow into the second chamber 314 and secondarily flow from the second chamber 314 to the first chamber 312 and be mixed with water. The first detergent mixed with water may be discharged to the outside of the second storage 300 via the first chamber 312 and supplied to the tub 20.

The drawer 340 retracted into the first chamber 312 may store the second detergent therein. When performing the washing course, the user may store the second detergent in the drawer 340 and retract the drawer into the receiving casing 310. When the washing course is performed, the second detergent may be mixed with water provided to the first chamber 312 and be discharged to the outside of the receiving casing 310.

However, the user may perform the washing course only with the first detergent in the first storage 200 without separately storing the second detergent in the second storage 300, which may correspond to a manual detergent supply, may perform the washing course only with the second detergent without separately storing the first detergent in the first storage 200, which may correspond to an automatic detergent supply, or may perform the washing course while the first detergent and the second detergent are stored in the first storage 200 and the second storage 300, respectively.

In one example, a detergent detector 330 may be disposed on the rear wall 318 of the first chamber 312. The detergent detector 330 may be disposed on the rear wall 318 of the first chamber 312 between the bottom surface of the first chamber 312 and the bottom surface of the second chamber 314 to detect the first detergent flowing toward the first chamber 312 from the second chamber 314. A detailed description of the detergent detector 330 will be made later.

A front surface of the receiving casing 310, that is, a front surface of the first chamber 312, may be opened to form the casing open surface, and the drawer 340 may be retracted or extended through the casing open surface.

A portion of the casing open surface may be a detergent discharge area 317 where the first detergent, the second detergent, or the water is discharged into the tub 20. The detergent discharge area 317 may be defined at a lower portion of the casing open surface.

In the casing open surface, the detergent discharge area 317 may be defined downwardly of the drawer 340 accommodated in the receiving casing 310. The first detergent, the second detergent, or water present in the first chamber 312 may flow along the bottom surface of the first chamber 312 because of a self-weight thereof, and the bottom surface of the first chamber 312 may be spaced downwardly apart from the drawer 340.

That is, the first detergent, the second detergent, or water may flow between the drawer 340 and the bottom surface of the first chamber 312 in the first chamber 312, and may be discharged through the detergent discharge area 317 of the casing open surface and be supplied into the tub 20 because of a falling phenomenon caused by the self-weight thereof.

In one example, as described above, the second storage 300 may include the receiving casing 310 including the first chamber 312, and the drawer 340 that accommodates the second detergent therein and is extendable from the first chamber 312. The first detergent introduced via the detergent pipe 420 and water introduced via the water supply pipe 620 may be mixed with the second detergent in the first chamber 312 and discharged to the tub 20.

The receiving casing 310 may further include the second chamber 314 connected to the detergent pipe 420 and into which the first detergent is introduced, and the second chamber 314 and the first chamber 312 may be in communication with each other and the first detergent may be delivered to the first chamber 312.

In one example. FIG. 19 shows the drawer 340 extended from the second storage 300 in an embodiment of the present disclosure. The drawer 340 may be retracted into or extended from the first space 313 through the casing open surface defined in the front surface of the receiving casing 310.

A top surface of the drawer 340 may be open, and the user may supply the second detergent into the drawer 340 via the open top surface of the drawer 340. Inside the drawer 340, a first accommodating portion 341 and a second accommodating portion 342 may be defined to be divided from each other, and the second detergent may be stored in the first accommodating portion 341 and the second accommodating portion 342.

In one example. FIG. 20 shows an exploded perspective view of the second storage 300. Referring to FIG. 20, in one embodiment of the present disclosure, the second storage 300 may include the drawer 340, the receiving casing 310, and a water diffuser 370.

A front surface 345 of the drawer 340 may be exposed forwardly of the receiving casing 310 and may be exposed to the user via the laundry inlet 101. The front surface 345 of the drawer 340 may form a handle that the user may grip.

The water diffuser 370 may be inserted into the receiving casing 310 to diffuse water supplied to the second storage 300. The water diffuser 370 may include a first diffuser 380 disposed in the first chamber 312 and a second diffuser 390 disposed in the second chamber 314.

In one example, FIG. 21 is a perspective view of the drawer 340. In the state in which the drawer 340 is inserted into the receiving casing 310, the front surface 345 of the drawer 340 may form a front surface of the second storage 300. The peripheral surface of the laundry inlet 101 of the top cover 100 may be opened at a location corresponding to the second storage 300 to expose the front surface 345 of the drawer 340 to the laundry inlet 101.

The top surface of the drawer 340 is open, so that the user may store the second detergent inside the drawer 340 even when the drawer 340 is completely removed from the receiving casing 310. For example, in a state in which the drawer 340 is extended from the receiving casing 310 such that only a portion of the open top surface of the drawer 340 is exposed, the user may store the second detergent via the open top surface.

The second detergent may be stored inside the drawer 340, and the drawer 340 may include the first accommodating portion 341 and the second accommodating portion 342, which are defined as the spaces divided from each other. The user may store different types of detergents in the first accommodating portion 341 and the second accommodating portion 342.

For example, the user may store detergent in a powder form in the first accommodating portion 341 and detergent in a liquid form in the second accommodating portion 342. The user may store a laundry detergent in the first accommodating portion 341 and a softener in the second accommodating portion 342.

A detergent cup 348 may be disposed in the second accommodating portion 342 of the drawer 340. The detergent cup 348 may provide a space to store the detergent in the liquid form, and may discharge all of the second detergent accommodated in the second accommodating portion 342 via a siphonage effect or the like.

As described above, in one embodiment of the present disclosure, the distinction between the first detergent and the second detergent may be based on the storage target, not the type or the form of the detergent.

A hole or an open surface may exist in a bottom surface or a rear surface of the drawer 340. The second detergent accommodated in the drawer 340 may leak out of the drawer 340 via the hole or the open surface defined in the bottom surface or the rear surface of the drawer 340.

FIG. 21 shows the drawer 340 with at least a portion of the rear surface thereof open. As will be described later, water may be supplied into the drawer 340, and the second detergent inside the drawer 340 may be discharged to the outside of the drawer 340 along with water via the open surface or the hole defined in the rear surface of the drawer 340.

In one example, FIG. 22 shows the receiving casing 310 of the second storage 300. With reference to FIG. 22, a structure of the receiving casing 310 will be summarized as follows.

The receiving casing 310 may provide a space in which the second detergent is accommodated or a space in which the drawer 340 is accommodated. At least a portion of the front surface of the receiving casing 310 may be open to define the casing open surface.

A portion of the casing open surface may define the detergent discharge area 317 for discharging the first detergent, the second detergent, and water from the receiving casing 310. For example, the drawer 340 may be located at an upper portion of the casing open surface, and the detergent discharge area 317 may be defined at a lower portion of the casing open surface.

A water diffusion plate may be disposed inside the receiving casing 310, and the water diffusion plate may be located upwardly of the drawer 340 within the receiving casing 310. Water flowing into the receiving casing 310 may be delivered to the drawer 340 or the like through the water diffusion plate.

In one example, FIG. 23 shows a cross-section of the inside of the second storage 300 viewed from above, and FIG. 24 shows a state in which the drawer 340 is disposed inside the receiving casing 310 in FIG. 23.

Referring to FIGS. 23 and 24, an inflow process of the first detergent in the second storage 300 will be described. First, in one embodiment of the present disclosure, the first detergent may be stored in the first storage 200. At least a portion of the first storage 200 may be exposed to the outside of the cabinet 10.

One embodiment of the present disclosure may be of a top loader type including the top cover 100 with the laundry inlet 101 defined therein. The storage body 210 of the first storage 200 may be exposed to the outside of the cabinet 10 and may be attachable to or detachable from the cabinet 10.

The second storage 300 may be disposed inside the cabinet 10 to accommodate the second detergent therein, and may be in communication with the tub 20. The first storage 200 may be the automatic detergent supply connected to the detergent pump 400, and the second storage 300 may be the manual detergent supply from which the second detergent accommodated with water is discharged.

The second storage 300 may include the first chamber 312 and the second chamber 314. The first chamber 312 may accommodate the second detergent therein and may be in communication with the tub 20, and the second chamber 314 may protrude from the first chamber 312 and allow the first detergent to flow thereinto.

The first detergent in the second chamber 314 may flow into the first chamber 312 and be discharged to the tub 20 together with the second detergent. The first chamber 312 may include the first space 313 in which the second detergent is accommodated, and the second chamber 314 may include the second space 315 extending away from the first space 313 and into which the first detergent flows.

The first detergent may fall along an opposite surface in the second space 315 and flow into the first space 313. That is, in one embodiment of the present disclosure, the first detergent in the first storage 200 may be supplied to the tub 20 via the second storage 300, and the space into which the first detergent flows may be set separately from the space in which the second detergent is stored in the second storage 300.

In one embodiment of the present disclosure, the first detergent is supplied to the tub 20 via the second storage 300, so that the first detergent may be mixed with water and provided via the second storage 300 even without a separate mixing tank. In addition, the first detergent and the second detergent may be supplied together to the tub 20 via the second storage 300, so that a supply structure of the detergent may be efficiently simplified.

In addition, in one embodiment of the present disclosure, the second storage 300 has the second chamber 314 into which the first detergent is to be introduced, separate from the first chamber 312 in which the second detergent is stored, so that a scattering range of the first detergent or an exposure range with respect to the first detergent may be effectively limited in the inflow process of the first detergent, making cleaning convenient and improving hygiene.

For example, when the first detergent flows into the first chamber 312, even when the user does not store the second detergent, the liquid first detergent may be supplied and distributed throughout the first chamber 312, and even when water is supplied into the first chamber 312, the first detergent may remain in areas that are not easy to clean, such as an area between the drawer 340 and an inner surface of the receiving casing 310.

Furthermore, when the first detergent scattered in the first chamber 312 is not completely dissolved in water and partially remains, deterioration of maintenance and manageability of the second storage 300, such as durability deterioration of a surface of the drawer 340 caused by the first detergent or the like, may occur.

Furthermore, as will be described later, a flow path of the first detergent may be defined separately within the second storage 300 via the inflow process of the first detergent using the second chamber 314, and accordingly, the detergent detector 330 for sensing the first detergent may be effectively disposed inside the second storage 300.

In FIGS. 23 and 24, the path through which the first detergent flowing into the second space 315 of the second chamber 314 flows into the first space 313 of the first chamber 312 is indicated by an arrow. One surface of the first chamber 312 may be open to be in communication with the tub 20, and the one surface may be the casing open surface described above.

A portion of the opposite surface of the first chamber 312 may be open to be in communication with the second chamber 314. The opposite surface of the first chamber 312 may correspond to the rear wall 318 of the first chamber 312. The rear wall 318 of the first chamber 312 may also be structurally defined as the rear wall 318 of the receiving casing 310.

The one surface and the opposite surface of the first chamber 312 may be positioned to be opposite to each other. That is, in one embodiment of the present disclosure, the one surface of the first chamber 312 may be open to be in communication with the tub 20 to discharge the first detergent and the second detergent, and the opposite surface thereof may be connected to the second chamber 314 to allow the first detergent to be introduced from the second chamber 314.

A length of the second chamber 314 in the width direction Y may increase in a direction toward the first chamber 312. That is, the second chamber 314 may include an inclined expanding portion 319 that extends obliquely toward the first chamber 312. The inclined expanding portion 319 may stabilize the flow of the first detergent introduced into the second chamber 314 and suppress scattering of the first detergent discharged from the second chamber 314 to the first chamber 312.

In one example, a transit portion 320 for the second detergent stored in the drawer 340 and water to flow out of the drawer 340 and flow to the bottom surface of the first chamber 312 may be formed on the rear wall 318 of the first chamber 312.

The transit portion 320 may provide a space for water supplied to the drawer 340 and the second detergent to flow into the detergent discharge area 317 defined in the bottom surface of the first chamber 312.

In one example. FIG. 25 shows a cross-section of the inside of the receiving casing 310 viewed in the width direction Y, and the flows of the first detergent, water, and the like are expressed by arrows. With reference to FIG. 25, the flow path of the first detergent will be described in detail as follows.

The receiving casing 310 may include the rear wall 318 located on an opposite side of the casing open surface. The second chamber 314 may protrude rearward from the rear wall 318. However, the second chamber 314 may protrude from both side walls other than the rear wall 318 of the first chamber 312, when necessary.

A portion where the second chamber 314 protrudes from the one surface of the first chamber 312 may be spaced upwardly apart from the bottom surface of the first chamber 312. The first detergent introduced from the second chamber 314 may flow toward the bottom surface of the first chamber 312 along the opposite surface.

The bottom surface of the second chamber 314 may be located at the vertical level higher than that of the bottom surface of the first chamber 312. The vertical level difference between the bottom surfaces of the first chamber 312 and the second chamber 314 may contribute to the generation of the flow of the first detergent from the second chamber 314 to the first chamber 312. The bottom surface of the second chamber 314 may be inclined downward in a direction toward the first chamber 312.

The second storage 300 may include a step forming portion. The step forming portion may form a portion of the flow path of the first detergent defined inside the second storage 300. The step forming portion may correspond to a portion of the rear wall 318 of the first chamber 312.

The step forming portion may be formed to be stepped such that a vertical level thereof relative to the ground is lowered. For example, the step forming portion may be a portion that connects the bottom surface of the first chamber 312 with the bottom surface of the second chamber 314, and the step forming portion may have the stepped shape because of the vertical level difference between the bottom surface of the first chamber 312 and the bottom surface of the second chamber 314.

The step forming portion may be located under the second chamber 314 in the rear wall 318 of the first chamber 312. That is, the first detergent discharged from the second chamber 314 may flow along the step forming portion and may reach the bottom surface of the first chamber 312.

Inside the first chamber 312, the drawer 340 may be spaced apart from the rear wall 318. Accordingly, the first detergent in the second chamber 314 may flow to the bottom surface of the first chamber 312 between the drawer 340 and the rear wall 318.

That is, the second chamber 314 may extend away from the drawer 340 on a peripheral surface of the first chamber 312, and the first detergent in the first chamber 312 may flow to the bottom surface of the first chamber 312 through a space between the peripheral surface and the drawer 340.

Specifically, when the first detergent flowing into the second chamber 314 flows to the bottom surface of the first chamber 312 via the step forming portion, a space in which the first detergent may flow may be required in front of the step forming portion, that is, between the rear wall 318 of the first chamber 312 and the drawer 340. The space may correspond to a space for the first detergent stored in the drawer 340 and water to flow out of the drawer 340 and flow to the bottom surface of the first chamber 312.

The step forming portion may extend inclined forward from the second chamber 314 to define a gap with the drawer 340 located in front of the step forming portion.

In one example, the drawer 340 may be spaced apart from the bottom surface of the first chamber 312 to define the detergent discharge area 317, and the first detergent and the second detergent may flow via the detergent discharge area 317 to be discharged from the receiving casing 310.

In one embodiment of the present disclosure, the detergent discharge area 317 may be defined as the space and may be defined to include the lower portion of the casing open surface described above. The detergent discharge area 317 may be defined as the lower portion of the first space 313, and may be defined between the bottom surface of the drawer 340 and the bottom surface of the first chamber 312.

The bottom surface of the first chamber 312 may be formed to be inclined toward the ground in a direction toward the casing open surface to induce the fluid present on the bottom surface of the first chamber 312 to flow toward the casing open surface.

In one embodiment of the present disclosure, the flow path of the first detergent may be defined inside the second storage 300. The flow path of the first detergent may include the bottom surface of the second chamber 314, the step forming portion, and the bottom surface of the first chamber 312.

Specifically, the first detergent flowing through the detergent pipe 420 may be discharged into the second space 315 of the second chamber 314 via the detergent connection port 321 of the second storage 300. The first detergent supplied to the second chamber 314 may flow toward the first chamber 312 along the bottom surface of the second chamber 314.

In one example, the first detergent deviating from the second space 315 of the second chamber 314 may flow down to the bottom surface of the first chamber 312 along the step forming portion extending from the bottom surface of the second chamber 314 toward the ground or the bottom surface of the first chamber 312.

The first detergent that has flowed into the first chamber 312 from the second chamber 314 may reach the bottom surface of the first chamber 312 by the self-weight thereof, and may flow along the bottom surface of the first chamber 312 and be discharged from the second storage 300 via the casing open surface.

The casing open surface may be located on the tub inlet 22, and thus the fluid discharged from the second storage 300 may be supplied into the tub 20.

In one example, referring to FIG. 25, the flow paths of the first detergent, the second detergent, and water within the second storage 300 will be described as follows.

First, as described above, the first detergent may pass through the detergent connection port 321, the bottom surface of the second chamber 314, the step forming portion, and the bottom surface of the first chamber 312 and be discharged from the second storage 300 via the detergent discharge area 317.

Water may be supplied into the first chamber 312 via the water connection port 322 disposed on the top surface of the first chamber 312. However, as will be described later, water supplied via the water connection port 322 may be delivered not only to the entire first chamber 312 but also to the inside of the second chamber 314 by the water diffuser 370.

That is, some of water supplied from the water connection port 322 may be provided into the first chamber 312, and the remainder may be provided into the second chamber 314. Water provided to the second chamber 314 may clean the inside of the second chamber 314 and may flow into the detergent discharge area 317 together with the first detergent in the second chamber 314.

The second detergent may be accommodated inside the drawer 340, and water supplied from the water connection port 322 may be provided into the drawer 340. The second detergent may be the detergent in the powder form, but may be mixed with water provided into the drawer 340 and treated as the fluid.

The second detergent may be discharged from the drawer 340 along with water. Because the drawer 340 may be accommodated inside the first chamber 312 of the receiving casing 310, the second detergent discharged from the drawer 340 may eventually flow toward the bottom surface of the first chamber 312.

At least the portion of the rear surface of the drawer 340 may be open, and the second detergent and water inside the drawer 340 may flow to the space between the drawer 340 and the rear wall 318 of the first chamber 312 via the open portion defined in the rear surface of the drawer 340.

Accordingly, the second detergent and/or water flowing out from the drawer 340 may be discharged from the second storage 300 via the detergent discharge area 317 that may be defined in the bottom surface of the first chamber 312.

The detergent discharge area 317 may be a common flow path through which the first detergent, the second detergent, and water flow. However, in a relationship with the second detergent, the bottom surface of the second chamber 314 or the step forming portion has a low possibility of contact with the second detergent, and thus is able to be understood as an independent flow path of the first detergent.

In one example, FIG. 26 shows the detergent detector 330 located on the flow path of the first detergent viewed from inside of the receiving casing 310, and FIG. 27 shows the detergent detector 330 disposed beneath the second chamber 314 viewed from the outside.

Referring to FIGS. 26 and 27, one embodiment of the present disclosure may include the detergent detector 330 that senses the first detergent on the flow path of the first detergent. The flow path of the first detergent may be defined within the second storage 300.

The detergent detector 330 may sense the first detergent and/or the second detergent. The detergent detector 330 may be disposed at a point on the flow path of the first detergent. For example, the detergent detector 330 may be disposed on at least one of the bottom surface of the second chamber 314, the step forming portion, and the bottom surface of the first chamber 312.

In one example, in one embodiment of the present disclosure, the detergent detector 330 may sense the first detergent, and in this case, the detergent detector 330 may be disposed on the flow path of only the first detergent, which is distinct from that of the second detergent.

For example, the detergent detector 330 may be disposed in the second chamber 314 or on the step forming portion. Furthermore, when the first detergent or the like sticks to a surface of the detergent detector 330, a malfunction of the detergent detector 330 may be caused, so that the detergent detector 330 may be disposed on the step forming portion that extends toward the ground to prevent the sticking of the first detergent or the like.

The step forming portion may correspond to a portion of the rear wall 318 that is approximately perpendicular to the ground in the receiving casing 310, and therefore a risk of sticking or the like may be reduced at the detergent detector 330 disposed on the step forming portion because the first detergent or the like flows because of the self-weight thereof.

That is, the detergent detector 330 may be disposed on the rear wall 318 of the first chamber 312, and may be located beneath the second chamber 314 on the rear wall 318 of the first chamber 312. That is, the detergent detector 330 may be disposed on the step forming portion connecting the bottom surface of the first chamber 312 with the bottom surface of the second chamber 314 at the location beneath the second chamber 314.

When viewed from the inside of the second storage 300, the detergent detector 330 may be located beneath the bottom surface of the second chamber 314 on the rear wall 318 of the receiving casing 310. The detergent detector 330 may be disposed between the bottom surface of the second chamber 314 and the bottom surface of the first chamber 312 on the flow path of the first detergent.

The detergent detector 330 may be of various types and may sense the first detergent or the like. For example, the detergent detector 330 may be formed in a shape of an electrode sensor including at least one pair of electrodes 331.

At least a portion of the electrode 331 of the detergent detector 330 may be exposed to the inside of the second storage 300. When the first detergent comes into contact with the pair of electrodes 331, a specific form is recorded in a sensing result of the detergent detector 330, which allows whether the first detergent is present to be identified.

In one embodiment of the present disclosure, the detergent detector 330 is located inside the second storage 300 to which water is supplied, so that the surface of the detergent detector 330 may be easily cleaned with water. In one embodiment of the present disclosure, a separate mixing tank for mixing the first detergent with water is omitted and the first detergent and water are mixed with each other via the second storage 300. Therefore, as the detergent detector 330 is disposed on the step forming portion of the second storage 300, maintenance of the detergent detector 330 may be easy and the first detergent may be effectively sensed.

In one example, the detergent detector 330 may have a dividing rib 332 protruding between the pair of electrodes 331. The dividing rib 332 may protrude from the detergent detector 330 toward the inside of the second storage 300 and may extend along the flow path of the first detergent.

Even when the first detergent or the like sticks to the surface, the detergent detector 330 may prevent the first detergent or the like from coming into contact with the pair of electrodes 331 via the dividing rib 332, so that misdetection or the like of the detergent detector 330 may be effectively reduced. The detergent detector 330 may be electrically connected to the pump control module 510 or the PCB module 520 described above.

In one example, FIG. 28 shows a cross-section of the detergent connection port 321 and the second chamber 314, and FIG. 29 shows a detergent discharge hole 327 viewed from the second space 315 of the second chamber 314.

Referring to FIGS. 28 and 29, the detergent connection port 321 including the connection part 325 may protrude from the second chamber 314, and the detergent connection port 321 may be in communication with the detergent discharge hole 327 defined in the top surface of the second chamber 314.

The detergent discharge hole 327 may also be understood as a hole defined at one end of the detergent connection port 321. When viewed from the inside of the second chamber 314, the first detergent may be introduced via the detergent discharge hole 327 defined in one surface of the second chamber 314.

In one embodiment of the present disclosure, the detergent discharge hole 327 may have a smaller area size than the detergent pipe 420 or the detergent connection port 321. In other words, a cross-sectional area of the detergent discharge hole 327 may be smaller than a flow cross-sectional area of the first detergent defined in the detergent pipe 420 or the detergent connection port 321. That is, the detergent discharge hole 327 may have a smaller area size than a flow path in the detergent pipe 420.

In other words, the second chamber 314 may include a shielding portion 328 that blocks a portion of the flow path in the detergent pipe 420 or the detergent connection port 321. The shielding portion 328 may be disposed on the detergent discharge hole 327.

That is, one embodiment of the present disclosure may include the shielding portion 328 that shields a portion of the detergent discharge hole 327 defined at the one end of the detergent connection port 321. In FIG. 29, the roughly circular detergent discharge hole 327 is indicated with a dotted line in the top surface of the second chamber 314, and the shielding portion 328 that partially blocks the detergent discharge hole 327 is shown.

In one embodiment of the present disclosure, as the cross-sectional area of the detergent discharge hole 327 is smaller than the cross-sectional area of the detergent connection port 321 because of the shielding portion 328 or the like, a flow resistance of the first detergent flowing along the detergent connection port 321 may occur when the first detergent passes through the discharge hole 327. As a result, a flow speed of the first detergent discharged into the second chamber 314 may be reduced, so that the scattering or the like of the first detergent may be suppressed.

In one example. FIG. 30 is a perspective view of the water diffuser 370 according to an embodiment of the present disclosure, and FIG. 31 is a top view of the water diffuser 370.

Referring to FIGS. 30 and 31, the water diffuser 370 is disposed in the first chamber 312 and extends to the second chamber 314 to deliver water that is supplied to the first chamber 312 toward the second chamber 314.

For example, the water supply pipe 620 that guides water supplied from the water supply source may be connected to the first chamber 312, and the second storage 300 may supply water supplied to the first chamber 312 to the second chamber 314.

As described above, water may be supplied to the second chamber 314 for diluting the first detergent and cleaning the inside of the second chamber 314 and the detergent detector 330. However, because of the nature of the second chamber 314 to limit the scattering or diffusion area of the first detergent, a volume of the second space 315 needs to be smaller than that of the first space 313.

However, when the second chamber 314 is equipped with the separate water connection port 322 for supplying water in addition to the detergent connection port 321, the volume of the second chamber 314 may be unnecessarily increased, and the scattering or the like of the first detergent may occur because of a high water pressure as water supplied via the water supply pipe 620 is directly provided.

Accordingly, in one embodiment of the present disclosure, the water connection port 322 is disposed in the first chamber 312, and at least some of water provided to the first chamber 312 is delivered to the second chamber 314 via the water diffuser 370, so that there is no need to connect the separate water supply pipe 620 to the second chamber 314 and water is able to be provided with the water pressure or the like adjusted.

The water diffuser 370 may be formed in an approximately plate shape and may be installed inside the receiving casing 310. The water diffuser 370 may be formed in a shape of a panel crossing a space between the top surface and the bottom surface of the receiving casing 310. The water diffuser 370 may have an area size and a shape corresponding to those of the top surface of the receiving casing 310.

The water diffuser 370 may include a plurality of water discharge holes 371 for allowing water to fall. The number, a size, a shape, and the like of the plurality of water discharge holes 371 may be determined in various ways based on a need.

The water diffuser 370 may be disposed under the water connection port 322. Water discharged from the water connection port 322 may be primarily located on the water diffuser 370, and may secondarily fall toward the bottom surface of the receiving casing 310 via the water discharge hole 371 or the like of the water diffuser 370.

That is, the water diffuser 370 may define a staying space in which water stays between the water connection port 322 and the water diffuser 370, and water in the staying space may be discharged into the receiving casing 310 with a location where water is to be supplied, a flow rate, a flow velocity, and the like adjusted via the water discharge holes 371 of the water diffuser 370. The water diffuser 370 may include a plurality of ribs protruding toward the top surface of the receiving casing 310 to guide the flow of water.

In one example, the water diffuser 370 may include the first diffuser 380 and the second diffuser 390. The first diffuser 380 may be located inside the first chamber 312, and the second diffuser 390 may be located inside the second chamber 314.

The first diffuser 380 may have a shape approximately corresponding to that of the top surface of the first chamber 312, and the second diffuser 390 may have a shape approximately corresponding to that of the top surface of the second chamber 314. The second diffuser 390 may extend from the first diffuser 380 located in the first chamber 312 toward the inside of the second chamber 314.

At least a portion of the first diffuser 380 may be located under the water connection port 322, and water falling from the water connection port 322 may pass through the first diffuser 380 and flow to the second diffuser 390, and thus be supplied into the second chamber 314.

The first diffuser 380 may have the plurality of water discharge holes 371 defined therein to discharge water into the first chamber 312, for example, into the drawer 340. The first diffuser 380 may have an area size corresponding to that of the drawer 340. The second detergent may be accommodated under the first diffuser 380.

The first diffuser 380 may include a first-first diffuser 382 and a first-second diffuser 384. The first-first diffuser 382 may be located above the first accommodating portion 341 of the drawer 340, and the first-second diffuser 384 may be located above the second accommodating portion 342 of the drawer 340.

In one example, the water diffuser 370 may include an overflow preventing portion 372. The overflow preventing portion 372 may include a circumferential portion protruding toward the top surface of the receiving casing 310 and may include an overflow preventing hole surrounded by the circumferential portion.

The overflow preventing portion 372 may quickly discharge water from the staying space when an amount of water stagnant on the water diffuser 370 increases to an amount equal to or greater than a certain amount, thereby reducing a flow pressure in the staying space.

A size of the overflow preventing hole may be greater than that of the water discharge hole 371, and the number, the size, locations, and the like of the overflow preventing holes may be determined in various ways based on a need. When a level of water stagnant on the water diffuser 370 is higher than a vertical level of the circumferential portion of the overflow preventing portion 372, water in the staying space may be discharged in a relatively large amount via the overflow preventing portion 372.

In one example, in one embodiment of the present disclosure, the water diffuser 370 may include an inclination forming portion 373. The inclination forming portion 373 may be located between the first diffuser 380 and the second diffuser 390 and may be formed to be inclined to guide water from the first diffuser 380 to the second diffuser 390.

The inclination forming portion 373 may include one end of the first diffuser 380. That is, the inclination forming portion 373 may be formed at the one end of the first diffuser 380. As described above, in one embodiment of the present disclosure, water and the detergent may flow between the drawer 340 and the rear wall 318 of the receiving casing 310, and accordingly, the inclination forming portion 373 may be disposed at a rear end of the first diffuser 380.

In addition, in one embodiment of the present disclosure, because the second chamber 314 may be disposed on the rear wall 318 of the first chamber 312, the inclination forming portion 373 may be located between the first diffuser 380 and the second diffuser 390. A vertical level of the second diffuser 390 may be lower than that of the first diffuser 380 because of the inclination forming portion 373.

The inclined forming portion 373 may be formed to be inclined downward from the first diffuser 380. Accordingly, water on the first diffuser 380 may flow toward a rear portion of the first diffuser 380, that is, toward the rear wall 318 of the receiving casing 310 by the inclination forming portion 373.

Water flowing toward the rear wall 318 of the first diffuser 380 may flow along the space between the drawer 340 and the rear wall 318 of the receiving casing 310, the transit portion 320 disposed on the rear wall 318 of the receiving casing 310, and/or the second diffuser 390.

The second diffuser 390 may include a guide rib that extends in a direction away from the first diffuser 380 and guides water. The guide rib may be disposed on the second diffuser 390 and may be in a form of a rib extending along the extension direction of the second diffuser 390 with respect to the first diffuser 380.

The guide rib protrudes toward the top surface of the second chamber 314 and extends in the direction away from the first diffuser 380 to allow water on the second diffuser 390 to flow to a rear portion of the second chamber 314.

In one example, FIG. 32 shows the water diffuser 370 disposed inside the receiving casing 310. The top surface of the second chamber 314 may have the detergent discharge hole 327 defined therein through which the first detergent is discharged, and the second diffuser 390 may be open at a portion corresponding to the detergent discharge hole 327 to allow the first detergent to pass therethrough.

In other words, the first detergent discharged via the detergent discharge hole 327 may not stay on the second diffuser 390, but pass through the second diffuser 390 and be supplied into the second chamber 314. Accordingly, a situation in which the first detergent unnecessarily comes into contact with the second diffuser 390 may be suppressed, and a situation in which a distribution area of the first detergent is increased via the water diffuser 370 may be suppressed. A size or a shape of an open area for passage of the first detergent in the second diffuser 390 may vary.

The first diffuser 380 has the water discharge holes 371 defined therein, so that water may be supplied into the second chamber 314. As water in the second diffuser 390 is discharged via the open area corresponding to the detergent discharge hole 327, a situation in which the first detergent flows onto the water diffuser 370 because of the flow of water may be suppressed.

FIG. 33 schematically shows a fluid flow inside the receiving casing 310 including the water diffuser 370. With reference to FIG. 33, the flow of water by the water diffuser 370 inside the receiving casing 310 will be described as follows.

The water connection port 322 may be disposed on the top surface of the first chamber 312, and water discharged via the water connection port 322 may primarily stay in the staying space defined between the first diffuser 380 of the water diffuser 370 and the top surface of the first chamber 312.

The water diffuser 370 may be designed such that the flow rate of water discharged via the plurality of water discharge holes 371 is smaller than a flow rate of water introduced via the water connection port 322. This may be realized by adjusting the size or the number of the water discharge holes 371.

Secondarily, some of water stagnating on the water diffuser 370 may fall via the water discharge holes 371 defined in the first diffuser 380 and be supplied into the first chamber 312 or into the drawer 340. The remainder of water stagnant on the water diffuser 370 may flow toward the second diffuser 390, be discharged along the rear wall 318 of the first chamber 312, or be discharged via the overflow preventing portion 372.

Water flowing into the drawer 340 via the first diffuser 380 may pass through the rear surface of the drawer 340 together with the second detergent and flow along the bottom surface of the first chamber 312.

In one example, water flowing into the second diffuser 390 by the inclination forming portion 373, the guide rib, and the like may fall toward the bottom surface of the second chamber 314. Water supplied to the second chamber 314 may be mixed with the first detergent, clean the inside of the second chamber 314 and the detergent detector 330, and reach the bottom surface of the first chamber 312 via the step forming portion.

Water supplied into the receiving casing 310 may eventually pass through the first diffuser 380 and the second diffuser 390, flow along the detergent discharge area 317 formed on the bottom surface of the first chamber 312, and be discharged via the casing open surface.

Although the present disclosure has been illustrated and described in connection with the specific embodiment, it would be obvious to a person skilled in the art that the present disclosure may be variously modified and changed without departing from the technical spirit of the present disclosure provided by the claims below.

What is claimed is:

1. A laundry treating apparatus comprising:

a cabinet;

a tub disposed inside the cabinet, the tub configured to receive water therein;

a first storage at least partially exposed outside of the cabinet, the first storage configured to receive a first detergent therein; and a second storage disposed inside the cabinet, the second storage including:

a first chamber configured to receive water and a second detergent therein, the first chamber being in communication with the tub;

a second chamber connected to the first chamber, the second chamber being configured to receive the first detergent from the first storage; and a water diffuser located in the first chamber, the water diffuser extending to the second chamber to deliver water, that is supplied to the first chamber, to the second chamber, wherein the first detergent, the second detergent, and water are mixed in the first chamber and supplied to the tub.

2. The laundry treating apparatus of claim 1, wherein the second storage includes a water connection port on a top surface of the first chamber, the water connection port being configured to be connected to a water supply pipe, and wherein the water diffuser is located under the water connection port to receive water from the water connection port.

3. The laundry treating apparatus of claim 2, wherein the water diffuser includes a plurality of water discharge holes.

4. The laundry treating apparatus of claim 1, wherein the water diffuser is located to cross a space between top surfaces and bottom surfaces of the first chamber and the second chamber.

5. The laundry treating apparatus of claim 1, wherein the water diffuser includes:

a first diffuser located inside the first chamber; and a second diffuser extending from the first diffuser, the second diffuser being located inside the second chamber.

6. The laundry treating apparatus of claim 5, wherein the second storage is configured such that at least some water supplied to the first chamber flows from the first diffuser to the second diffuser, falls downward from the second diffuser, and then is supplied into the second chamber.

7. The laundry treating apparatus of claim 5, wherein the second storage is configured such that some water supplied to the first chamber falls toward a bottom surface of the first chamber via the first diffuser, and a remainder of the water falls toward a bottom surface of the second chamber via the second diffuser.

8. The laundry treating apparatus of claim 5, wherein the water diffuser further includes an inclined portion located between the first diffuser and the second diffuser, the inclined portion being inclined to guide water from the first diffuser to the second diffuser.

9. The laundry treating apparatus of claim 8, wherein the inclined portion is inclined downward in a direction from the first diffuser to the second diffuser.

10. The laundry treating apparatus of claim 5, wherein the second diffuser includes a guide rib extending in a direction away from the first diffuser to guide water.

11. The laundry treating apparatus of claim 10, wherein the second diffuser is located to cross a space between a top surface and a bottom surface of the second chamber.

12. The laundry treating apparatus of claim 5, wherein a top surface of the second chamber has a hole therein to receive the first detergent from the first storage, and wherein the second diffuser has an open portion corresponding to the hole in the top surface of the second chamber.

13. The laundry treating apparatus of claim 5, wherein the first chamber is configured to receive the second detergent therein at a location under the first diffuser, and wherein the first diffuser includes a plurality of water discharge holes to allow water to be discharged downward therethrough.

14. The laundry treating apparatus of claim 13, wherein the second storage includes a drawer configured to receive the second detergent therein, the drawer being retractable into the first chamber, and wherein the first diffuser is disposed at the drawer to supply water into the drawer.

15. The laundry treating apparatus of claim 13, wherein at least a portion of the water diffuser is located to cross a space between a top surface and a bottom surface of the first chamber, and wherein the water diffuser includes an overflow preventing portion having:

a circumferential portion protruding toward the top surface of the first chamber; and a hole surrounded by the circumferential portion.

16. The laundry treating apparatus of claim 1, wherein a first surface of the first chamber is open to be in communication with the tub, and a portion of a second surface opposite the first surface is open to be in communication with the second chamber.

17. The laundry treating apparatus of claim 1, wherein the second storage is configured such that the first detergent received the second chamber is discharged into the tub via the first chamber.

18. The laundry treating apparatus of claim 17, wherein the second storage includes a step portion located between a bottom surface of the first chamber and a bottom surface of the second chamber, and wherein the second storage is configured such that the first detergent flows toward the first chamber via the step portion of the second chamber.

19. The laundry treating apparatus of claim 18, wherein the step portion extends obliquely from the bottom surface of the second chamber toward the bottom surface of the first chamber, and wherein the second storage is configured such that the first detergent in the second chamber is discharged toward the tub via the bottom surface of the second chamber, the step portion, and the bottom surface of the first chamber.

20. The laundry treating apparatus of claim 18, wherein the second storage includes a detergent detector located on the step portion, the detergent detector being configured to sense the first detergent.

* * * * *